US010532576B2

(12) United States Patent
Ogawa et al.

(10) Patent No.: US 10,532,576 B2
(45) Date of Patent: Jan. 14, 2020

(54) LIQUID JETTING APPARATUS

(71) Applicant: Brother Kogyo Kabushiki Kaisha, Nagoya-shi, Aichi-ken (JP)

(72) Inventors: Mikio Ogawa, Nagoya (JP); Takahiro Miyao, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/044,588

(22) Filed: Jul. 25, 2018

(65) Prior Publication Data

US 2019/0100014 A1 Apr. 4, 2019

(30) Foreign Application Priority Data

Sep. 29, 2017 (JP) ..... 2017-189854

(51) Int. Cl.
*B41J 29/38* (2006.01)
*B41J 2/165* (2006.01)

(52) U.S. Cl.
CPC ..... *B41J 2/16552* (2013.01); *B41J 2/16508* (2013.01); *B41J 2/16517* (2013.01); *B41J 2/16526* (2013.01); *B41J 2002/16573* (2013.01); *B41J 2002/16582* (2013.01)

(58) Field of Classification Search
CPC ..... B41J 2/17596
USPC ..... 347/6
See application file for complete search history.

(56) References Cited

U.S. PATENT DOCUMENTS

| | | | | |
|---|---|---|---|---|
| 7,448,714 | B2 | 11/2008 | Mizuno | |
| 8,136,917 | B2 | 3/2012 | Sakurai | |
| 9,586,398 | B2 | 3/2017 | Kato et al. | |
| 2005/0219282 | A1* | 10/2005 | Kachi | B41J 2/175 347/6 |
| 2005/0231575 | A1* | 10/2005 | Bannai | B41J 2/14274 347/100 |
| 2005/0264602 | A1 | 12/2005 | Mizuno | |
| 2009/0066737 | A1 | 3/2009 | Sakurai | |
| 2009/0195571 | A1* | 8/2009 | Shimada | B41J 2/175 347/6 |

(Continued)

FOREIGN PATENT DOCUMENTS

| | | | |
|---|---|---|---|
| JP | 2005-335238 | A | 12/2005 |
| JP | 2009-066849 | A | 4/2009 |

(Continued)

*Primary Examiner* — Lam S Nguyen
(74) *Attorney, Agent, or Firm* — Banner & Witcoff, Ltd.

(57) ABSTRACT

A liquid jetting apparatus includes: a head which jets liquid supplied from a liquid tank; a memory which stores pieces of reference data; and a controller which estimates viscosity of the liquid in the liquid tank every time a predefined time passes. The controller acquires a total supply amount or cumulative supply amount of the liquid supplied from the liquid tank and a supply amount of the liquid per unit time within the predefined time, estimates a viscosity change amount of the liquid in the liquid tank based on the cumulative supply amount acquired, the supply amount per unit time acquired, and the pieces of reference data, and estimates the viscosity of the liquid in the liquid tank based on the viscosity change amount estimated and the viscosity of the liquid in the liquid tank at an initial timing point or a most-recent estimation timing point.

20 Claims, 13 Drawing Sheets

VISCOSITY CHANGE IN INK FLOWING THROUGH OUTLET OF SUB TANK UNDER PV500 (25°C)

| ELAPSED MONTH | 0 | 1 | 2 | 3 | 4 | 5 | 6 | 7 | 8 | 9 |
|---|---|---|---|---|---|---|---|---|---|---|
| VISCOSITY(cps) | 4.0 | 4.3 | 4.6 | 4.5 | 4.4 | 4.3 | 4.1 | 3.9 | 3.7 | 3.5 |

VISCOSITY CHANGE IN INK FLOWING THROUGH OUTLET OF SUB TANK UNDER PV100 (25°C) AND PV500 (25°C)

(56) References Cited

U.S. PATENT DOCUMENTS

| | | | | |
|---|---|---|---|---|
| 2011/0122177 | A1* | 5/2011 | Hiroki | C09D 11/30 347/6 |
| 2011/0128313 | A1* | 6/2011 | Matoba | B41J 2/175 347/6 |
| 2013/0002741 | A1* | 1/2013 | Takahashi | B41J 2/155 347/6 |
| 2016/0271942 | A1 | 9/2016 | Kato et al. | |

FOREIGN PATENT DOCUMENTS

| | | | |
|---|---|---|---|
| JP | 2015-134468 | A | 7/2015 |
| JP | 2016-175302 | A | 10/2016 |

* cited by examiner

Fig. 4A

VISCOSITY CHANGE IN INK FLOWING THROUGH OUTLET OF SUB TANK UNDER PV100 (25°C)

| ELAPSED MONTH | 0 | 1 | 2 | 3 | ... | 9 | 10 | 11 | 12 | 13 | ... | 39 | 40 |
|---|---|---|---|---|---|---|---|---|---|---|---|---|---|
| VISCOSITY(cps) | 4.0 | 4.5 | 5.0 | 5.4 | ... | 7.9 | 8.1 | 8.2 | 8.1 | 7.8 | ... | 3.1 | 3.0 |

Fig. 4B

VISCOSITY CHANGE IN INK FLOWING THROUGH OUTLET OF SUB TANK UNDER PV500 (25°C)

| ELAPSED MONTH | 0 | 1 | 2 | 3 | 4 | 5 | 6 | 7 | 8 | 9 |
|---|---|---|---|---|---|---|---|---|---|---|
| VISCOSITY(cps) | 4.0 | 4.3 | 4.6 | 4.5 | 4.4 | 4.3 | 4.1 | 3.9 | 3.7 | 3.5 |

Fig. 4D

PV100 (25°C) REFERENCE DATA

| USE PERIOD n | 0 | 1 | 2 | ... | 9 | 10 | 11 | 12 | ... | 38 | 39 |
|---|---|---|---|---|---|---|---|---|---|---|---|
| TOTAL FLOWING AMOUNT Ex(ml) | 0 | 4 | 8 | ... | 36 | 40 | 44 | 48 | ... | 152 | 156 |
| FIRST VISCOSITY CHANGE AMOUNT ΔV1(cps/month) | 0.5 | 0.5 | 0.4 | ... | 0.2 | 0.1 | -0.1 | -0.3 | ... | -0.1 | -0.1 |
| SECOND VISCOSITY CHANGE AMOUNT ΔV2(cps/ml) | 0.13 | 0.13 | 0.10 | ... | 0.05 | 0.03 | -0.03 | -0.08 | ... | -0.03 | -0.03 |

Fig. 4E

PV500 (25°C) REFERENCE DATA

| USE PERIOD n | 0 | 1 | 2 | 3 | 4 | 5 | 6 | 7 | 8 |
|---|---|---|---|---|---|---|---|---|---|
| TOTAL FLOWING AMOUNT Ex(ml) | 0 | 18 | 36 | 54 | 72 | 90 | 108 | 126 | 144 |
| FIRST VISCOSITY CHANGE AMOUNT ΔV1(cps/month) | 0.3 | 0.3 | -0.1 | -0.1 | -0.1 | -0.1 | -0.2 | -0.2 | -0.2 |
| SECOND VISCOSITY CHANGE AMOUNT ΔV2(cps/ ml ) | 0.13 | 0.05 | -0.03 | -0.03 | -0.03 | -0.03 | -0.05 | -0.05 | -0.05 |

LIQUID JETTING APPARATUS

CROSS REFERENCE TO RELATED APPLICATION

The present application claims priority from Japanese Patent Application No. 2017-189854 filed on Sep. 29, 2017, the disclosure of which is incorporated herein by reference in its entirety.

BACKGROUND

Field of the Invention

The present invention relates to a liquid jetting apparatus.

Description of the Related Art

Japanese Patent Application Laid-open No. 2015-134468 discloses an ink-jet recording apparatus as an exemplary liquid jetting apparatus. The ink-jet recording apparatus includes a head with nozzles from which ink supplied from an ink tank (a liquid tank) is jetted. Such an ink-jet recording apparatus may have ink jetting failure caused by thickening of ink in the nozzles, thus requiring head maintenance. For example. Japanese Patent Application Laid-open No. 2015-134468 describes that the increase in a printing count causes the difference in frequency of use between nozzles of the head, increasing the viscosity of the ink in a nozzle, of the nozzles of the head, having low frequency of use. In order to solve that problem, Japanese Patent Application Laid-open No. 2015-134468 describes that a time interval between pieces of maintenance is shortened as the printing count increases.

SUMMARY

The viscosity of the liquid in a predefined area of the liquid tank is not constant, but changes. For example, when the liquid stored in the liquid tank is a pigment ink and the pigment ink is left stationary for a long time, the pigment falls and the viscosity of the pigment ink on the bottom of the liquid tank increases. Namely, the viscosity of the pigment ink is highest on the bottom of the liquid tank, and the viscosity decreases toward an upper side of the liquid tank. Thus, when an ink supply port of the liquid tank is provided at a lower portion of the liquid tank, the viscosity of the pigment ink in the vicinity of the ink supply port increases with time, unless the pigment ink flows out from the ink supply port. Here, when the pigment ink flows out from the ink supply port of the liquid tank, the pigment ink having high viscosity on the bottom of the liquid tank flows out. The viscosity of the pigment ink in the vicinity of the ink supply port thus decreases as the pigment ink flows out from the ink supply port of the liquid tank.

When the liquid stored in the liquid tank is a dye ink, water or moisture of the dye ink evaporates in the liquid tank. This increases the viscosity of the dye ink in the liquid tank with time. As described above, the viscosity of the liquid in the predefined area of the liquid tank changes, thus changing the viscosity of the liquid supplied from the liquid tank to the head.

In the ink-jet recording apparatus disclosed in Japanese Patent Application Laid-open No. 2015-134468, the time interval between pieces of head maintenance is set without reflecting the change in the viscosity of the liquid supplied from the liquid tank to the head. This may cause a problem of discharging the liquid unnecessarily, a problem of not getting rid of the jetting failure in the head, and the like. In order to properly perform an operation such as the head maintenance, it is desired that the viscosity of the liquid in the predefined area of the liquid tank can be estimated.

An object of the present teaching is to provide a liquid jetting apparatus that is capable of estimating a viscosity of a liquid in a predefined area of a liquid tank.

According to a first aspect of the present teaching, there is provided a liquid jetting apparatus, including: a head configured to jet liquid supplied from a liquid tank; a memory configured to store pieces of reference data, each of the pieces of reference data being reference data related to estimated change in viscosity of the liquid in the liquid tank on an assumption that a supply amount of the liquid supplied from the liquid tank per unit time is a fixed amount, the pieces of reference data being different in the fixed amount; and a controller configured to estimate the viscosity of the liquid in the liquid tank every time a predefined time passes, wherein, in the case of estimating the viscosity of the liquid in the liquid tank, the controller is configured to: acquire a total supply amount of the liquid supplied from the liquid tank after an initial timing point at which the liquid in the liquid tank is suppliable to the head and before a most-recent estimation timing point of the viscosity of the liquid in the liquid tank, or a cumulative supply amount being a total supply amount of the liquid supplied from the liquid tank after the initial timing point and before a current estimation timing point of the viscosity of the liquid in the liquid tank, and a supply amount of the liquid supplied from the liquid tank per unit time within the predefined time, estimate a viscosity change amount being a change amount of the viscosity of the liquid in the liquid tank within the predefined time based on the cumulative supply amount acquired, the supply amount per unit time acquired, and the pieces of reference data stored in the memory, and estimate the viscosity of the liquid in the liquid tank based on the viscosity change amount estimated and the viscosity of the liquid in the liquid tank at the initial timing point or the most-recent estimation timing point of the viscosity of the liquid in the liquid tank.

According to a second aspect of the present teaching, there is provided a liquid jetting apparatus, including: a head configured to jet liquid supplied from a liquid tank; a memory configured to store initial viscosity data and pieces of reference data, the initial viscosity data being related to initial viscosity which is viscosity of the liquid in the liquid tank at an initial timing point at which the liquid in the liquid tank is suppliable to the head, each of the pieces of reference data being reference data related to estimated change in the viscosity of the liquid in the liquid tank on an assumption that a supply amount of the liquid supplied from the liquid tank per unit time is a fixed amount, the pieces of reference data being different in the fixed amount; and a controller configured to estimate the viscosity of the liquid in the liquid tank every time a predefined time passes and to store, in the memory, the viscosity estimated as viscosity of the liquid in the liquid tank at the time of the estimation, wherein, in the case of estimating the viscosity of the liquid in the liquid tank, the controller is configured to: acquire a cumulative supply amount including at least a total supply amount of the liquid supplied from the liquid tank after the initial timing point and before a most-recent estimation timing point of the viscosity of the liquid in the liquid tank, and a supply amount of the liquid supplied from the liquid tank per unit time within the predefined time, estimate a viscosity change amount being a change amount of the viscosity of the liquid in the liquid tank within the predefined time based on the cumulative supply amount acquired, the supply amount per unit time acquired, and the pieces of reference data stored in the memory, and estimate the viscosity of the liquid in the liquid tank based on the viscosity change amount estimated, and the initial viscosity or a latest viscosity of the liquid in the liquid tank being stored in the memory before a current estimation timing point of the viscosity of the liquid in the liquid tank.

In the present teaching, each of the pieces of reference data indicates the estimated change in the viscosity of the liquid in the liquid tank. The pieces of reference data have mutually different supply amounts of the liquid supplied from the liquid tank per unit time. The viscosity of the liquid in the liquid tank can thus be estimated by referring to the supply amount per unit time acquired, the cumulative supply amount acquired, and the pieces of reference data.

BRIEF DESCRIPTION OF THE DRAWINGS

FIGS. 4A to 4E each illustrate change in a viscosity of ink in the vicinity of an outlet of the sub tank.

DESCRIPTION OF THE EMBODIMENTS

Figure 1:
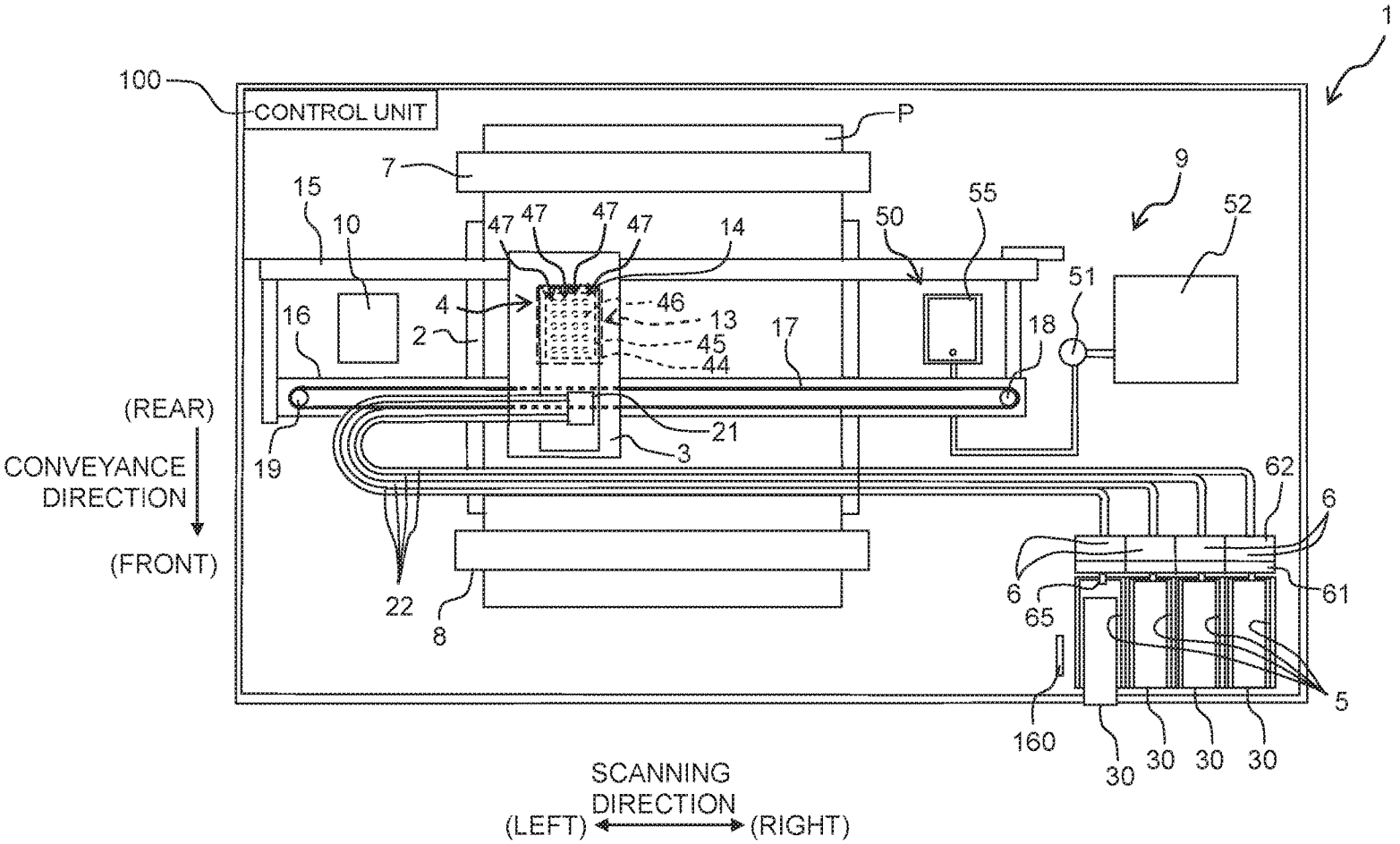
FIG. 1 schematically depicts a configuration of an ink-jet printer according to an embodiment.

A schematic configuration of an ink-jet printer 1 according to an embodiment of the present teaching is explained. The printer 1 is used in a posture depicted in FIG. 1. The printer 1 includes a platen 2, a carriage 3, an ink-jet head 4 (hereinafter also simply referred to as a head 4), four tank installation sections 5, four sub tanks 6, a feed roller 7, a discharge roller 8, a purge unit 9, a flushing receiver 10, a temperature sensor 160, a touch panel 161 (see FIG. 2), a controller 100, and the like. In the following, a side of the front surface of FIG. 1 is defined as an upper side of the printer 1, and a side of the back surface of FIG. 1 is defined as a lower side of the printer 1. A front-rear direction and a left-right direction indicated in FIG. 1 are defined as a front-rear direction and a left-right direction of the printer 1. The following explanation is made based on those definitions.

A sheet S, which is a recording medium, is placed on an upper surface of the platen 2. Two guide rails 15 and 16 extending parallel to the left-right direction (a scanning direction) are provided above the platen 2.

The carriage 3, which is attached to the two guide rails 15 and 16, is movable along the two guide rails 15 and 16 in the left-right direction within an area facing the platen 2. A drive belt 17 is attached to the carriage 3. The drive belt 17 is an endless belt wound around two pulleys 18 and 19. The pulley 18 is coupled to a carriage drive motor 20 (see FIG. 2). Rotating and driving the pulley 18 by the carriage drive motor 20 causes the drive belt 17 to travel, thus moving the carriage 3 reciprocatingly in the left-right direction. The head 4 carried on the carriage 3 reciprocates in the left-right direction together with the carriage 3.

The four tank installation sections 5, which are positioned in front of the carriage 3 (the head 4), are arranged in the left-right direction. Main tanks 30 are removably installed in the tank installation sections 5, respectively. The four main tanks 30 installed in the four tank installation sections 5 store pigment inks of black, yellow, cyan, and magenta, respectively. Each of the four tank installation sections 5 includes an installation detection sensor 130 (see FIG. 2) to detect whether the main tank 30 is installed in the tank installation section 5.

The four sub tanks 6, which are positioned on the front side of the carriage 3 and on a rear side of the four tank installation sections 5, are arranged in the left-right direction. The four sub tanks 6 correspond to the four tank installation sections 5, respectively. Each of the sub tanks 6 is a tank for separating gas from liquid. When each of the main tanks 30 is installed in the corresponding one of the tank installation sections 5, the sub tank 6 communicates with the main tank 30, supplying the ink from the main tank 30 to the sub tank 6. The sub tanks 6 are connected to the head 4 via flexible supply tubes 22. Configurations of the main tank 30 and the sub tank 6 are described below.

The head 4 is carried on the carriage 3. The head 4 includes a head body 13 and buffer tanks 14. A tube joint 21 is integrally provided on the buffer tanks 14. First ends of the four supply tubes 22 are removably connected to the tube joint 21. Second ends of the four supply tubes 22 are connected respectively to the four sub tanks 6. The respective inks in the four main tanks 30 installed in the tank installation sections 5 are supplied to the buffer tanks 14 via the sub tanks 6 and the supply tubes 22.

The head body 13 is attached to lower portions of the buffer tanks 14. The head body 13 includes a channel unit 44 and an actuator 45. The channel unit 44 includes interior channels with nozzles 46, which are open in a nozzle surface 44*a* (see FIG. 3) that is a lower surface of the channel unit 44. Those interior channels communicate with the buffer tanks 14. The ink supplied from each of the buffer tanks 14 via the interior channels is jetted from the nozzles 46. In the nozzle surface 44*a*, the nozzles 46 form four nozzle rows 47 arranged in the left-right direction. Each of the nozzle rows 47 extends in the front-rear direction. The inks of black, yellow, cyan, and magenta are jetted from the four nozzle rows 47 in order from the nozzle row 47 arranged in the rightmost position. The actuator 45 applies jetting energy individually to the ink in each nozzle 46. The actuator 45 may be an actuator that applies pressure to the ink by changing a volume of a pressure chamber (not depicted) communicating with the nozzle 46 or an actuator that applies pressure to the ink by generating bubbles in the pressure chamber by means of heating. Since the configuration itself of the actuator 45 is publicly known, any further detailed explanation is omitted here.

The head 4 is disposed above the main tanks 30 installed in the tank installation sections 5 and the sub tanks 6. This configuration generates a head difference between the ink in each nozzle 46 and a liquid surface of the ink in each main tank 30 and/or between the ink in each nozzle 46 and a liquid surface of the ink in each sub tank 6 to apply, to the ink in each nozzle 46, negative pressure acting toward a main tank 30 side. The ink is thus prevented from being jetted from each nozzle 46 when no printing is performed.

Figure 2:
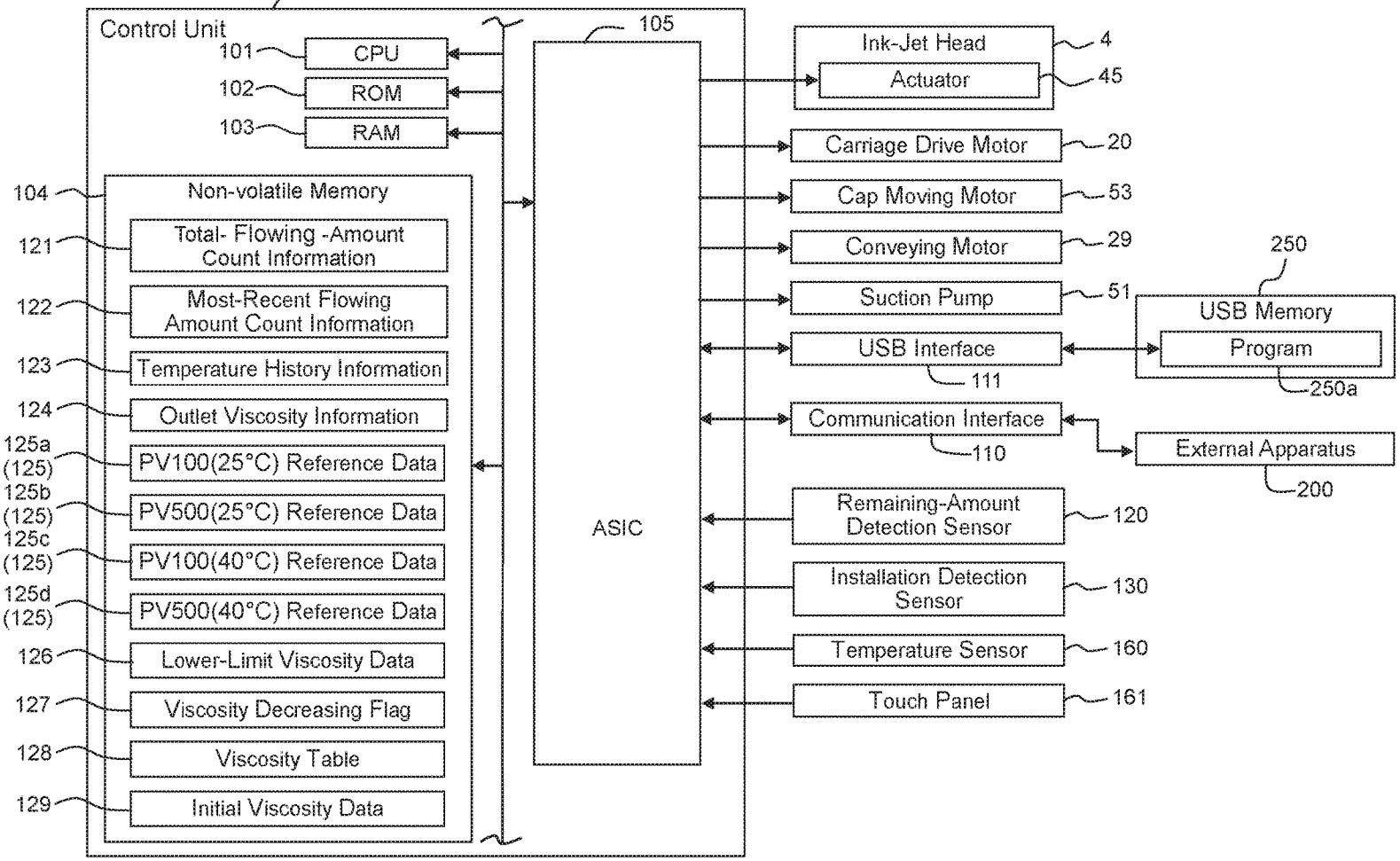
FIG. 2 is a block diagram schematically depicting an electrical configuration of the ink-jet printer.

The feed roller 7 and the discharge roller 8 are driven and rotated synchronously with each other by a conveying motor 29 (see FIG. 2). The feed roller 7 and the discharge roller 8 cooperate to convey the sheet S placed on the platen 2 frontward (in a conveyance direction).

The printer 1 prints a desired image and the like on the sheet S by alternately and repeatedly performing a conveyance operation by which the sheet P is conveyed in the conveyance direction by use of the feed roller 7 and the discharge roller 8, and a jetting operation by which the ink is jetted from each nozzle 46 during the movement of the carriage 3 and the head 4 in the left-right direction. Namely, the printer 1 of this embodiment is an ink-jet printer of a serial system.

The flushing receiver 10 is disposed on a left side of the platen 2. The nozzles 46 face the flushing receiver 10 in an up-down direction in a state where the head 4 carried on the carriage 3 is in a flushing position. The printer 1 drives the actuator 45 of the head 4 in the state where the head 4 is in the flushing position. This discharges thickened ink and the like from the nozzles 46 to the flushing receiver 10. Namely, a flushing operation is performed.

The purge unit 9 performs a maintenance operation for preventing jetting performance of the nozzles 46 from deteriorating and recovering the jetting performance. The purge unit 9 includes a cap unit 50, a suction pump 51, a waste liquid tank 52, and the like.

The cap unit 50 is disposed on a right side of the platen 2. The nozzles 46 face the cap unit 50 in the up-down direction in a state where the carriage 3 is positioned on the right side of the platen 2. Further, the cap unit 50 is driven by a cap moving motor 53 (see FIG. 2) to be ascendable (liftable) and descendable in the up-down direction (movable in the up-down direction). The cap unit 50 includes a cap 55 that is installable in the head 4 by coming into contact therewith. The cap 55 is made, for example, using a rubber material.

The cap 55 faces a lower surface of the head body 13 in a state where the head 4 faces the cap unit 50. Driving the cap moving motor 53 under that situation moves the cap unit 50 upward from a separated position below the head 4 to a capping position where the cap unit 50 comes into contact with the head 4, installed in the head 4. When the cap unit 50 is installed in the head 4, the cap 55 covers all the nozzles 46 belonging to the four nozzle rows 47. The cap 55 is connected to the suction pump 51 that is a rotary pump.

Driving the suction pump 51 by the controller 100 in the state where the cap 55 covers the nozzles 46 reduces pressure (performs suction) in the cap 55. This suctions the inks from the nozzles 46 (a suction purge). The suction purge forcibly discharges the inks having a high viscosity in the nozzles 46 from the nozzles 46, recovering the jetting performance of the nozzles 46. The inks discharged through the suction purge are held in the waste liquid tank 52.

The temperature sensor 160 is disposed in the vicinity of the tank installation sections 5 to measure ambient temperature. The touch panel 161 is a user interface that accepts various kinds of operation input from a user and displays various setting screens, operation statuses, and the like thereon for the user.

As depicted in FIG. 2, the controller 100 includes, for example, a Central Processing Unit (CPU) 101, a Read Only Memory (ROM) 102, a Random Access Memory (RAM) 103, a non-volatile memory 104, and an Application Specific Integrated Circuit (ASIC) 105. The ROM 102 stores programs executed by the CPU 101, various kinds of fixed data, and the like. The RAM 103 temporarily stores data (printing data, and the like) required for executing the programs. The non-volatile memory 104 stores, for example, total-flowing-amount count information 121 described below. The ASIC 105 is connected to various devices or drive units of the printer 1, such as the head 4 and the carriage drive motor 20. The ASIC 105 is connected to an external apparatus 200, such as a PC, via a communication interface 110. The ASIC 105 is connected to a USB interface 111. A program 250*a* and the like stored in a USB memory 250 is installed in the controller 100 via the USB interface 111.

The CPU 101 executes print processing in which an image and the like is printed on the sheet P by controlling the head 4, the carriage drive motor 20, and the like based on a printing command sent from the external apparatus 200. The CPU 101 executes discharge processing in which the inks are discharged from the nozzles 46 of the head 4. The discharge processing includes the suction purge using the purge unit 9 and the flushing using the actuator 45 of the head 4.

In the above description, an example in which various kinds of processing are executed by the CPU 101 of the controller 100 has been explained. The various kinds of processing, however, may be executed by the CPU 101 and ASIC 105 operating in cooperation with each other. The controller 100 may include multiple CPUs 101 to make the CPUs 101 perform pieces of processing in a shared manner. The controller 100 may include multiple ASICs 105 to make the ASICs 105 perform pieces of processing in a shared manner. The single ASIC 105 may execute pieces of processing.

The configurations of the main tank 30 and the sub tank 6 are explained below.

Figure 3:
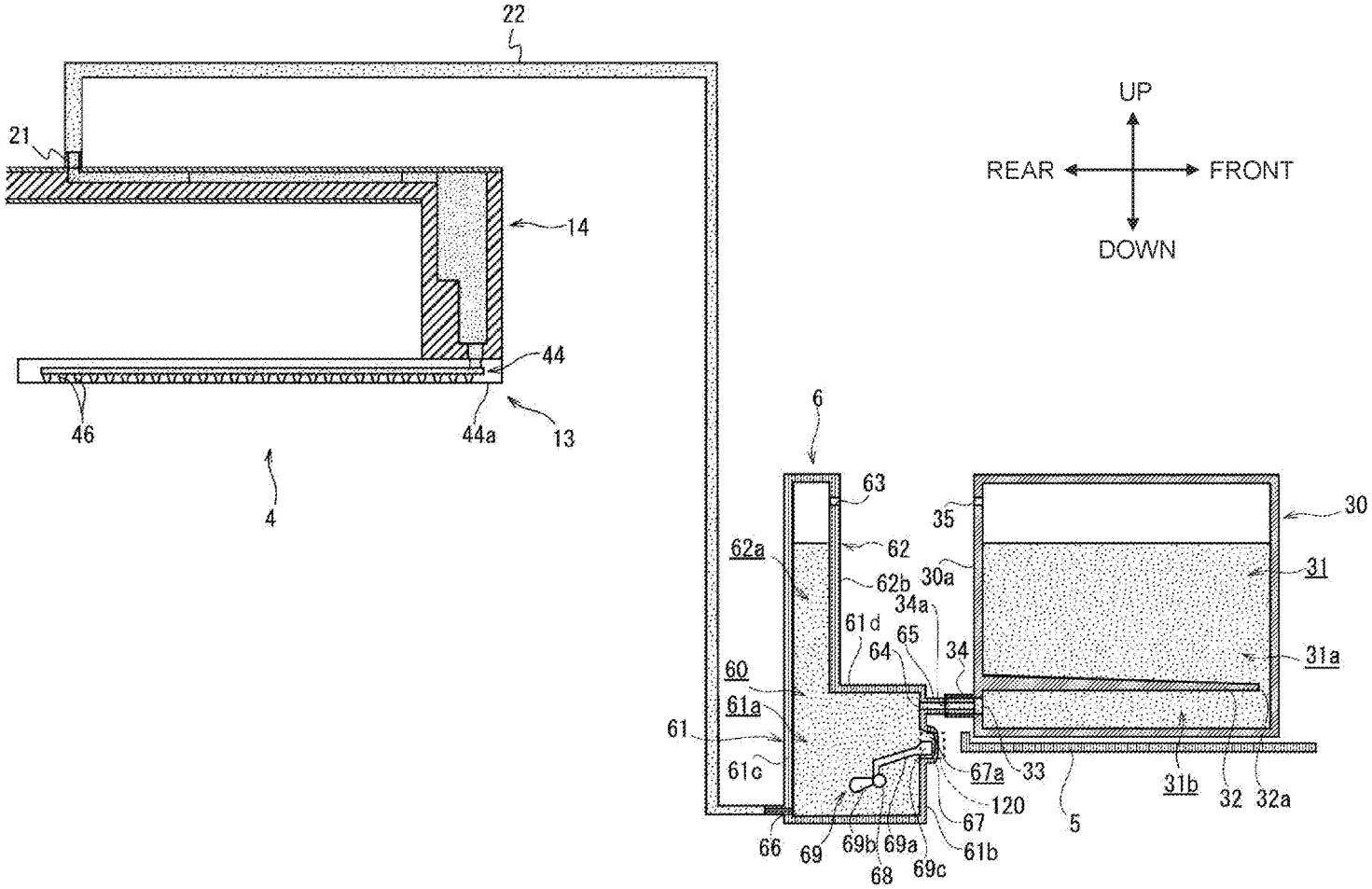
FIG. 3 is a vertical cross-sectional view schematically depicting an ink-jet head, a main tank, and a sub tank.

As depicted in FIG. 3, the main tank 30 installed in the tank installation section 5 is adjacent to the sub tank 6 in a horizontal direction. More specifically, the main tank 30 and the sub tank 6 are arranged in the horizontal direction such that the main tank 30 is adjacent to the sub tank 6 in the front-rear direction. The main tank 30 has substantially a rectangular parallelopiped shape. The main tank 30 includes an internal space 31 storing ink therein.

The main tank 30 includes a partitioning plate 32 that extends in the horizontal direction to partition the internal space 31 into an upper ink chamber 31*a* and a lower ink channel 31*b*. A connection hole 32*a* passes through a front end of the partitioning plate 32 in the up-down direction. The connection hole 32*a* allows the ink chamber 31*a* and the ink channel 31*b* to communicate with each other.

A supply port 33 passes through a rear wall 30*a* of the main tank 30 in the front-rear direction at a lower side of the partitioning plate 32. Namely, the ink channel 31*b* has the supply port 33. The supply port 33 is an opening for supplying the ink stored in the internal space 31 to the outside. A cylindrical ink supply part 34, which extends rearward, is provided in a portion of the rear wall 30*a* at which the supply port 33 is formed. An internal space of the ink supply part 34 communicates with the internal space 31 via the supply port 33. A rear end of the ink supply part 34 is provided with an insertion hole 34*a* into which a needle 65 described below is inserted. The insertion hole 34*a* is closed by a valve (not depicted) in a state where the main tank 30 is not installed in the tank installation section 5. Installing the main tank 30 in the tank installation section 5 causes the needle 65 of the sub tank 6 to push and move the valve, opening the insertion hole 34*a*.

An atmosphere communication port 35 passes through an upper portion of the rear wall 30*a* of the main tank 30 in the front-rear direction. The atmosphere communication port 35 allows a gas layer present on an upper side of a liquid surface of ink stored in the ink chamber 31*a* to communicate with the outside (the atmosphere). Although not depicted in the drawings, the atmosphere communication port 35 may include a check valve that allows the flow of fluid from the outside of the main tank 30 into the ink chamber 31*a* and regulates the flow of fluid from the ink chamber 31*a* to the outside of the main tank 30. The atmosphere communication port 35 may include a gas permeable film that allows gas to permeate therethrough and prevents liquid, such as ink, from permeating therethrough. In order to prevent the ink from leaking outside through the atmosphere communication port 35, a channel having a labyrinth structure and connected to the atmosphere communication port 35 may be provided outside the rear wall 30*a*.

The printer 1 may have a posture different from that depicted in FIG. 1 in a case of, for example, transportation of the printer 1. For example, the printer 1 may have a posture in which its rear surface is positioned on a lower side of its front surface. In that case, unlike the usable posture depicted in FIG. 1, the liquid surface of ink stored in the ink chamber 31*a* of each main tank 30 installed in the tank installation section 5 is positioned on an upper side of the head 4, not causing the negative pressure that acts toward the main tank 30 and applied to the ink in the nozzles 46. This may cause a situation in which a large amount of the ink in each main tank 30 positioned above the nozzles 46 of the head 4 leaks through the nozzles 46. In this embodiment, however, each main tank 30 includes the partitioning plate 32, and the connection hole 32*a* allowing the ink chamber 31*a* and the ink channel 31*b* to communicate with each other is formed at the front end of the partitioning plate 32. This allows the connection hole 32*a* to be positioned at an uppermost position in the ink chamber 31*a* when the rear surface of the printer 1 is positioned on the lower side. The ink in the ink chamber 31*a* is thus prevented from flowing to the ink channel 31*b*, which prevents a large amount of ink from leaking through the nozzles 46.

Next, the sub tank 6 is explained. The sub tank 6 is formed mainly from a body 61 having a rectangular parallelopiped shape and an upper part 62 having a rectangular parallelopiped shape and extending upward from an upper end of the body 61. The body 61 includes a lower storage chamber 61*a* and the upper part 62 includes an upper storage chamber 62*a*. An internal space 60 is formed by causing the lower storage chamber 61*a* and the upper storage chamber 62*a* to communicate with each other. A capacity of the internal space 60 of the sub tank 6 is smaller than a capacity of the internal space 31 of the main tank 30. A cross-section of the internal space 60 of the sub tank 6 in the horizontal direction is smaller than a cross-section (a bottom area) of the internal space 31 of the main tank 30 in the horizontal direction.

The upper storage chamber 62*a* is positioned above the partitioning plate 32 of the main tank 30 when the main tank 30 is installed in the tank installation section 5. A length of the upper storage chamber 62*a* in the left-right direction is the same as that of the lower storage chamber 61*a* in the left-right direction. A length of the upper storage chamber 62*a* in the front-rear direction is shorter than that of the lower storage chamber 61*a* in the front-rear direction. Thus, a cross-section of the upper storage chamber 62*a* in the horizontal direction is smaller than a cross-section of the lower storage chamber 61*a* in the horizontal direction. Further, the cross-section of the upper storage chamber 62*a* in the horizontal direction is greatly smaller than the cross-section of the ink chamber 31*a* of the main tank 30 in the horizontal direction (e.g., the cross-section of the upper storage chamber 62*a* in the horizontal direction is approximately 5% of the cross-section of the ink chamber 31*a* of the main tank 30 in the horizontal direction).

An atmosphere communication port 63 passes through an upper portion of a front wall 62*b* of the upper part 62 in the front-rear direction. The atmosphere communication port 63 allows a gas layer present on an upper side of a liquid surface of ink stored in the internal space 60 to communicate with the outside (the atmosphere). Although not depicted in the drawings, the atmosphere communication port 63 may include a gas permeable film that allows gas to permeate therethrough and prevents liquid, such as ink, from permeating therethrough. In order to prevent the ink from leaking outside through the atmosphere communication port 63, a channel having a labyrinth structure and connected to the atmosphere communication port 63 may be provided outside the front wall 62*b*.

An inlet 64 passes through a front wall 61*b* of the body 61 in the front-rear direction. Namely, the lower storage chamber 61*a* has the inlet 64. The ink flows from the outside of the sub tank 6 to the internal space 60 of the sub tank 6 via the inlet 64. The cylindrical needle 65, which extends frontward, is provided in a portion of the front wall 61*b* at which the inlet 64 is formed. An internal space of the needle 65 communicates with the internal space 60 of the sub tank 6 via the inlet 64. The needle 65 is inserted into the insertion hole 34*a* of the main tank 30 when the main tank 30 is installed in the tank installation section 5, causing the supply port 33 of the main tank 30 and the inlet 64 of the sub tank 6 to communicate with each other via the needle 65. The ink stored in the internal space 31 of the main tank 30 is thus supplied to the internal space 60 of the sub tank 6 via the supply port 33 and the inlet 64.

An outlet 66 passes through a lower portion of a rear wall 61*c* of the body 61 in the front-rear direction. Namely, the lower storage chamber 61*a* has the outlet 66. The ink stored in the internal space 60 of the sub tank 6 flows to the outside via the outlet 66. The supply tube 22 is connected to the outlet 66, allowing the ink stored in the main tank 30 and the sub tank 6 to be supplied to the head 4 via the supply tube 22.

The outlet 66 is disposed below the inlet 64. The outlet 66 is disposed below the internal space 31 of the main tank 30 installed in the tank installation section 5.

A convex portion 67 protruding frontward is provided in the front wall 61*b* of the body 61 at the lower side of the needle 65. The convex portion 67 includes a detecting chamber 67*a*, which is a part of the internal space 60. The convex portion 67 is made using a resin material that has a light transmissive property.

The lower storage chamber 61*a* includes a float mechanism 69 that is pivotally movable around a support shaft 68 provided in the body 61. The float mechanism 69 includes an arm 69*a* extending frontward from the support shaft 68, a float part 69*b* extending rearward from the support shaft 68, and a light blocking part 69*c* provided at a front end of the arm 69*a*.

The float part 69*b* is a hollow member of which average specific gravity is lighter than specific gravity of ink. The arm 69*a* is smaller in weight than the float part 69*b*. The arm 69*a* is designed so that buoyancy acting on the arm 69*a* in a state where the arm 69*a* is immersed in the ink is smaller than that acting on the float part 69*b* in a state where the float part 69*b* is immersed in the ink.

In the above configuration, when a position of a liquid surface of ink stored in the lower storage chamber 61*a* is equal to or higher than a predefined detection position, the float part 69*b* is immersed in the ink. This makes buoyancy reverse the balance of weight between the float part 69*b* and the arm 69*a*, causing the float mechanism 69 to pivot about the support shaft 68 in a direction in which the float part 69*b* moves upward (a clockwise direction in FIG. 3). In that case, the light blocking part 69*c* moves obliquely downward to enter the detecting chamber 67*a*.

When the position of the liquid surface of ink stored in the lower storage chamber 61*a* is lower than the detection position, the float mechanism 69 pivots about the support shaft 68 in a direction in which the float part 69*b* moves downward (a counterclockwise direction in FIG. 3). During the pivoting of the float mechanism 69, the light blocking part 69*c* moves obliquely upward to leave the detecting chamber 67*a*. Accordingly, the position of the light blocking part 69*c* depends on the position in the up-down direction of the liquid surface of ink stored in the lower storage chamber 61*a*.

The printer 1 includes a remaining-amount detection sensor 120. The remaining-amount detection sensor 120 is a transmission-type light sensor, which includes a light emitting element and a light receiving element (not depicted) that are disposed to face each other with the convex portion 67 of the sub tank 6 intervening therebetween in the left-right direction. The detecting chamber 67*a* of the convex portion 67 is put on an optical path between the light emitting element and the light receiving element of the remaining-amount detection sensor 120. In that configuration, when the light blocking part 69*c* of the float mechanism 69 is positioned in the detecting chamber 67*a*, the light receiving element receives no light emitted from the light emitting element. When the position of the light blocking part 69*c* changes to leave the detecting chamber 67*a*, the light receiving element receives the light. The remaining-amount detection sensor 120 outputs information related to the position of the light blocking part 69*c*, that is, information related to the level of the liquid surface of ink stored in the lower storage chamber 61*a*, to the controller 100 based on whether the light receiving element has received the light emitted from the light emitting element. This allows the CPU 101 of the controller 100 to determine based on the output result from the remaining-amount detection sensor 120 whether the liquid surface of ink stored in the lower storage chamber 61*a* is less than the detection position. In the following, the state where the liquid surface is less than the detection position is referred to as a near empty state. In this embodiment, the detection position is higher than the outlet 66 and lower than the inlet 64.

As a modified example, the convex portion 67 may extend upward from an upper wall 61*d* of the body 61 instead of being provided in the front wall 61*b* of the body 61. In that configuration, the arm 69*a* of the float mechanism 69 extends upward from the support shaft 68. As a result, the position of the light blocking part 69*c* provided at the front end of the arm 69*a* changes in the left-right direction depending on the change in the position in the up-down direction of the liquid surface of ink stored in the lower storage chamber 61*a*. In this modified example also, the CPU 101 can determine based on the output result from the remaining-amount detection sensor 120 whether the liquid surface of ink stored in the lower storage chamber 61*a* is in the near empty state. In this modified example, no convex portion 67 is provided in the front wall 61*b* of the body 61, creating a space below the connection portion between the needle 65 and the ink supply port 34. This makes it possible to place, in the space, an ink receiver and the like that is capable of receiving ink leaking from the connection portion.

Subsequently, an explanation is made on the flow of ink after the main tank 30 is installed in the tank installation section 5. Installing the main tank 30 in the tank installation section 5 inserts the needle 65 of the sub tank 6 into the insertion hole 34*a* of the main tank 30, allowing the supply port 33 of the main tank 30 and the inlet 64 of the sub tank 6 to communicate with each other. This supplies the ink stored in the internal space 31 of the main tank 30 to the internal space 60 of the sub tank 6.

The internal space 31 of the main tank 30 is open to the atmosphere through the atmosphere communication port 35. The internal space 60 of the sub tank 6 is open to the atmosphere via the atmosphere communication port 63. The ink is thus supplied from the main tank 30 to the sub tank 6 until the liquid surface of ink in the main tank 30 and the liquid surface of ink in the sub tank 6 have the same height due to their head differences. Thereafter, when the ink is jetted or discharged from the nozzles 46 through the print processing, discharge processing, or the like, the ink is supplied from the sub tank 6 to the head 4 via the outlet 66 to lower the liquid surface of ink in the main tank 30 and the liquid surface of ink in the sub tank 6 until they have the same height.

In a configuration in which the supply port 33 of the main tank 30 is directly connected to the supply tube 22, when the ink is jetted or discharged from the nozzles 46 after the main tank 30 has become empty, air enters the supply tube 22. This deteriorates the jetting performance of the nozzles 46. In order to deal with that problem, the following configuration may be adopted. Namely, when an ink remaining amount in the main tank 30 is less than a predefined amount that is greater than zero, a message or the like informing the user of the necessity of replacement of the main tank 30 is displayed on the touch panel 161. In that configuration, however, the replacement may be performed before the main tank 30 installed in the tank installation section 5 becomes empty.

In this embodiment, the sub tank 6 separating gas from liquid is disposed between the main tank 30 and the supply tube 22, solving the above problem.

As described above, the outlet 66 of the sub tank 6 is disposed below the inlet 64. Namely, the outlet 66 is disposed below the main tank 30 installed in the tank installation section 5. The ink is thus stored in the lower storage chamber 61*a* (above the outlet 66) of the sub tank 6 when the main tank 30 has become empty. This prevents air from entering the supply tube 22 immediately after the main tank 30 has become empty.

When the CPU 101 has determined based on the output result from the remaining-amount detection sensor 120 that the liquid surface of ink in the sub tank 6 is in the near empty state in which the liquid surface is less than the detection position, the massage informing the user of the necessity of replacement of the main tank 30 is displayed on the touch panel 161. Since the detection position is above the outlet 66, no air enters the supply tube 22 when the near empty state is detected. Accordingly, in this embodiment, the ink in the main tank 30 is effectively used while air is prevented from entering the supply tube 22.

In order to recover the jetting performance of the nozzles 46 through the discharge processing such as the suction purge and the flushing, a discharge amount of the ink to be discharged from each nozzle 46, etc., is required to be changed depending on the viscosity of the ink in the nozzle 46. For example, in the suction purge, drive conditions of the suction pump 51, such as rotation time and rotation velocity, are required to be changed so that the discharge amount increases as the viscosity of the ink in the nozzle 46 is higher. In the flushing, drive conditions of the actuator 45 are required to be changed so that an ink-jetting count increases as the viscosity of the ink in the nozzle 46 is higher or so that a jetting amount per one jetting increases as the viscosity of the ink in the nozzle 46 is higher. The viscosity of the ink in the nozzle 46 is thus required to be accurately estimated.

The viscosity of the ink in the nozzle 46 depends on the viscosity of the ink flowing out through the outlet 66 of the sub tank 6 (the viscosity of the ink flowing through the outlet 66). The viscosity of the ink flowing through the outlet 66 is not constant, but changes. The viscosity of the ink flowing through the outlet 66 is thus required to be accurately estimated to accurately estimate the viscosity of the ink in the nozzle 46. In the following, an explanation is made on the reason why the viscosity of the ink flowing through the outlet 66 changes.

As described above, the ink stored in each main tank 30 is the pigment ink. The pigment of the pigment ink is dispersed in a solvent. When the pigment ink is left stationary for a long time, the pigment of which specific gravity is large falls on the bottom of the main tank 30. Thus, when the main tank 30 is left stationary for a long time, a large amount of the pigment falls on the bottom of the ink main tank 30. This locally increases a pigment concentration of the pigment ink on the bottom of the main tank 30, thus locally increasing the viscosity thereof. Meanwhile, a pigment concentration of the pigment ink in the vicinity of the liquid surface in the main tank 30 is low, and thus the viscosity thereof is low. The main tank 30 has such viscosity distribution that the ink viscosity is highest on the bottom and lowers toward the upper side.

As described above, the viscosity of the ink on the bottom of the main tank 30 is higher as the fall amount of the pigment increases with time, unless the ink flows out from the supply port 33 to the sub tank 6. When the ink flows out from the supply port 33, the thickened ink on the bottom of the main tank 30 flows out. In that case, the viscosity of the ink on the bottom of the main tank 30 lowers as the ink flows out from the supply port 33. The viscosity of the pigment ink is lower as the temperature in the main tank 30 is higher, facilitating the pigment fall. The viscosity distribution of the ink in the main tank 30 thus depends on the flowing amount of ink flowing out through the supply port 33, the temperature in the main tank 30, the elapsed time elapsed after an installation timing point at which the main tank 30 is installed in the tank installation section 5, and the like. As a result, the viscosity of the ink flowing out from the main tank 30 to the sub tank 6 via the supply port 30 changes.

Similar to the main tank 30, the sub tank 6 has such viscosity distribution that the ink viscosity is highest on the bottom and lowers toward the upper side. The fall amount of pigment that falls in the tank per unit time increases as the capacity of the tank is greater or the cross-section of the tank in the horizontal direction is greater. As described above, the capacity of the internal space 60 of the sub tank 6 is smaller than the capacity of the internal space 31 of the main tank 30. Further, the cross-section of the internal space 60 of the sub tank 6 in the horizontal direction is smaller than the cross-section (the bottom area) of the internal space 31 of the main tank 30 in the horizontal direction. Thus, the fall amount of the pigment that falls per unit time in the sub tank 6 is smaller than the fall amount of the pigment that falls per unit time in the main tank 30. Since the sub tank 6 is different in shape from the main tank 30, the viscosity distribution of the sub tank 6 is different from that of the main tank 30.

The ink supplied from the supply port 33 of the main tank 30 to the sub tank 6 mixes with the ink in the sub tank 6, lowering the viscosity thereof. Then, the ink flows out from the outlet 66 of the sub tank 6 to the head 4. More specifically, when a predefined amount of ink flows out from the outlet 66 during a predefined period, the predefined amount of ink includes the ink stored in the main tank 30 and the ink stored in the sub tank 6 at a predefined mixture ratio at the beginning of the predefined period.

With the above configuration, the viscosity of the ink flowing through the outlet 66 depends on the flowing amount of the ink flowing out through the outlet 66, the temperature in the main tank 30, the elapsed time after the installation timing point, and the like. Referring FIGS. 4A to 4C, one example is explained.

FIGS. 4A and 4B are pieces of viscosity change data each indicating a relation between the viscosity of the ink flowing through the outlet 66 and a total flowing amount on condition that the temperature in the main tank 30 is fixed to 25° C. and the flowing amount of ink flowing out through the outlet 66 of the sub tank 6 per unit time (in this embodiment, one month) is a fixed amount. Each piece of viscosity change data indicates monthly viscosity change after the installation timing point (also referred to as an initial timing point) until the main tank 30 becomes empty. The installation timing point (the initial timing point) is the first timing point at which the ink stored in the main tank 30 is suppliable to the head 4 via the outlet 66 of the sub tank 6 by installing the main tank 30 in the tank installation section 5. Thus, in the installation timing point, the total amount of the ink stored in the main tank 30 and the ink stored in the sub tank 6 is the same as an amount of ink stored in a new main tank 30 that is not yet installed in the tank installation section 5. In this embodiment, the CPU 101 determines the installation timing point based on a detection result from the installation detection sensor 130.

Figure 4C:
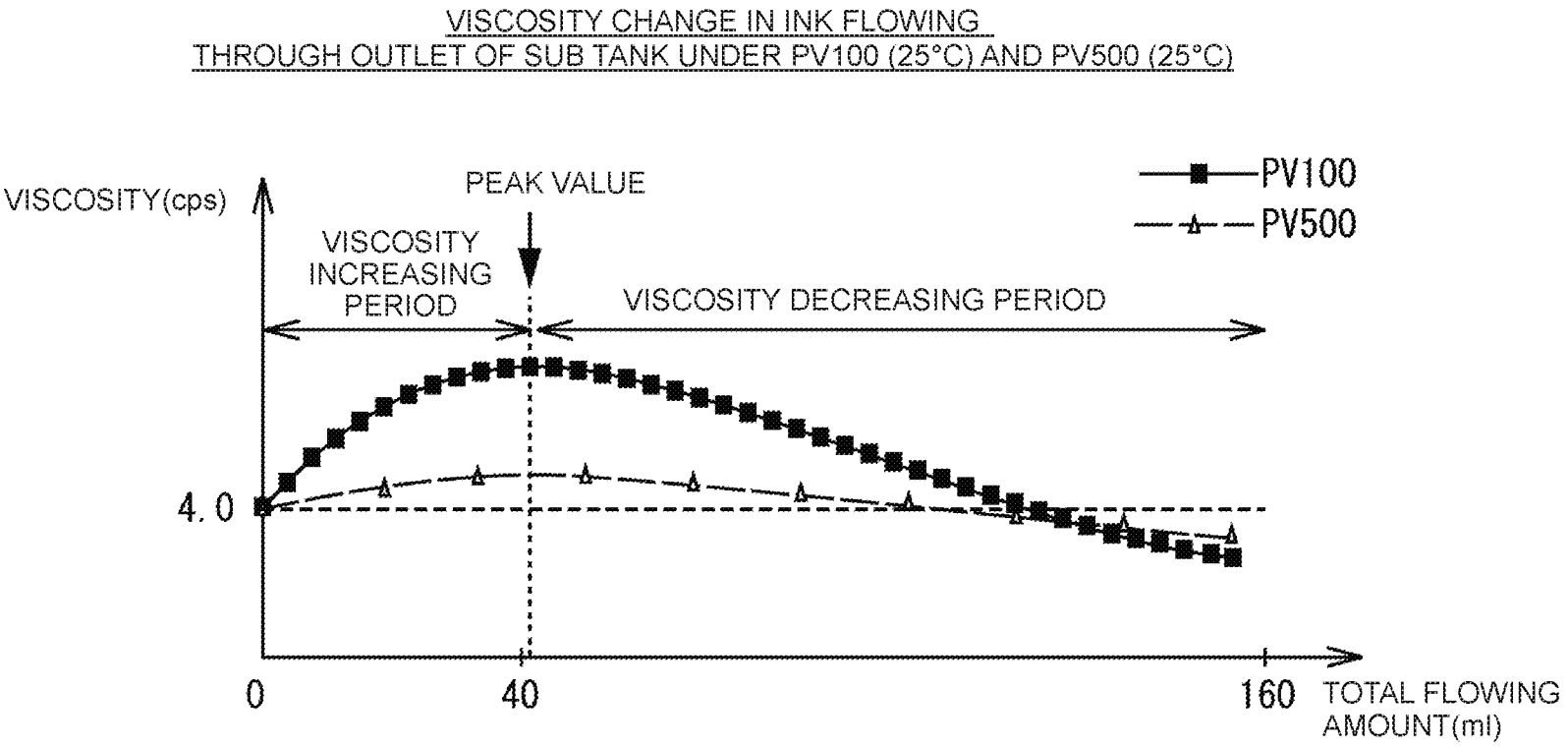

An initial viscosity of the ink flowing through the outlet 66 is set to 4.0 cps that is an initial viscosity of the ink in the main tank 30. FIG. 4A is viscosity change data (hereinafter referred to as PV100 viscosity change data) when 4 ml is set as the fixed amount, 4 ml being an approximate flowing amount when the number of sheets printed per one month (hereinafter referred to as PV) is 100. FIG. 4B is viscosity change data (hereinafter referred to as PV500 viscosity change data) when 18 ml is set as the fixed amount, 18 ml being an approximate flowing amount when the PV is 500. Those pieces of viscosity change data are acquired by an experiment, simulation, or the like. FIG. 4C shows the pieces of viscosity change data graphically. Namely, FIG. 4C is a diagram in which the relation between the viscosity of the ink flowing through the outlet 66 and the total flowing amount for each piece of viscosity change data is plotted for each month.

As understood from FIG. 4C, both in the PV100 viscosity change data and the PV500 viscosity change data, the viscosity of the ink flowing through the outlet 66 increases every time one month passes, during a period after the installation timing point until the total flowing amount reaches approximately 40 ml (hereinafter referred to as a viscosity increasing period). This is because, when a remaining amount of ink in the main tank 30 is large, an influence of the increase in viscosity due to the pigment fall with time is greater than an influence of the decrease in viscosity due to the flowing out of ink through the outlet 66. Further, since the PV100 viscosity change data has the flowing amount of ink flowing out through the outlet 66 per unit time that is smaller than that of the PV500 viscosity change data, the PV100 viscosity change data has the increase in the viscosity of the ink flowing through the outlet 66 with time that is greater than that of the PV500 viscosity change data. The PV100 viscosity change data thus has a peak value of the viscosity of the ink flowing through the outlet 66 that is greater than that of the PV500 viscosity change data.

Meanwhile, both in the PV100 viscosity change data and the PV500 viscosity change data, the viscosity of the ink flowing through the outlet 66 decreases every time one month passes, during a period (hereinafter referred to as a viscosity decreasing period) after the viscosity of the ink flowing through the outlet 66 reaches the peak value at a timing point at which the total flowing amount is approximately 40 ml. This is because, when the remaining amount of ink in the main tank 30 is equal to or less than the predefined amount, a supernatant, of the ink remaining in the main tank 30, having a low viscosity (having little pigment) is mixed and the ink mixed with the supernatant is supplied from the supply port 33 to the sub tank 6. Namely, the influence of the decrease in viscosity due to the flowing out of ink through the outlet 66 is greater than the influence of the increase in viscosity due to the pigment fall with time. Further, both in the PV100 viscosity change data and the PV500 viscosity change data, a final viscosity of the ink flowing through the outlet 66 when the main tank 30 has become empty is a value lower than 4.0 cps that is the initial viscosity. This is because, the ink of the supernatant of which viscosity is lower than 4.0 cps is supplied from the supply port 33 to the head 4 immediately before the main tank 30 becomes empty. Since the viscosity of the ink mixed with the supernatant in the PV100 viscosity change data is lower than that in the PV500 viscosity change data, the final viscosity of the ink flowing through the outlet 66 in the PV100 viscosity change data is lower than that in the PV500 viscosity change data.

As described above, the viscosity of the ink flowing through the outlet 66 depends on the flowing amount of ink flowing out through the outlet 66 per unit time.

Here, each piece of viscosity change data such as the PV100 viscosity change data or the PV500 viscosity change data, may be stored in the non-volatile memory 104 while mapped to the corresponding PV. If the PV for each month is the same, the viscosity of the ink flowing through the outlet 66 can be accurately estimated by referring to one piece of viscosity change data that corresponds to the PV mapped. In this case, however, many pieces of viscosity change data are required to be stored in the non-volatile memory 104, making the non-volatile memory 104 tight. Further, since the viscosity of the ink flowing through the outlet 66 depends also on the temperature in the main tank 30, it is necessary to store the viscosity change data for each temperature that is mapped to each PV.

Actually, the PV of the printer 1 is likely to change for each month, and the flowing amount of ink flowing out through the outlet 66 per unit time is likely to change for each month. Thus, the method of estimating the viscosity of the ink flowing through the outlet 66 by referring to one piece of viscosity change data has bad estimation accuracy.

In order to solve the above problem, in this embodiment, the non-volatile memory 104 stores the total-flowing-amount count information 121, most-recent flowing amount count information 122, temperature history information 123, outlet viscosity information 124, and four kinds of reference data 125, as depicted in FIG. 2. The viscosity estimation processing of estimating the viscosity of the ink flowing through the outlet 66 is executed based on those pieces of information stored in the non-volatile memory 104, every time predefined time (one month in this embodiment) passes. Details thereof are explained below.

The total-flowing-amount count information 121 indicates a total flowing amount of ink flowing out through the outlet 66 after the installation timing point. The CPU 101 calculates the flowing amount of ink every time the ink flows out through the outlet 66 in the print processing, discharge processing, or the like, and adds the calculated flowing amount to a count value of the total-flowing-amount count information 121. The jetting amount of ink to be jetted from each nozzle 46 in the print processing or flushing can be calculated by using the drive conditions of the actuator 45. The discharge amount of ink to be discharged from each nozzle 46 in the suction purge can be calculated by using the drive conditions of the suction pump 51, such as rotation velocity and rotation time. Accordingly, it is also possible to calculate the flowing amount of ink flowing out through the outlet 66.

The most-recent flowing amount count information 122 indicates the count value of the total-flowing-amount count information 121 at a reference timing point which is one of the installation timing point and a timing point of most-recent execution of the viscosity estimation processing, whichever is later.

The temperature history information 123 is history information of the temperature measured by the temperature sensor 160 after the reference timing point. The CPU 101 adds the temperature measured by the temperature sensor 160 to the temperature history information 123 every time a certain amount of time (one hour in this embodiment) is clocked by an internal clock. The outlet viscosity information 124 indicates a viscosity of the ink flowing through the outlet 66. At the installation timing point, 4.0 cps, which is the initial viscosity of the ink flowing through the outlet 66, is stored as the outlet viscosity information 124. The initial viscosity is stored in the non-volatile memory 104 as initial viscosity data 129.

Four kinds of reference data 125 are related to estimated change in the viscosity of the ink flowing through the outlet 66 when the flowing amount of ink flowing out through the outlet 66 per unit time is determined as the fixed amount. The four kinds of reference data 125 include PV100 (25° C.) reference data 125*a*, PV500 (25° C.) reference data 125*b*, PV100 (40° C.) reference data 125*c*, and PV500 (40° C.) reference data 125*d*.

As depicted in FIGS. 4D and 4E, each piece of reference data 125 indicates a correspondence relation between each period (one month in this embodiment, hereinafter referred to as a use period) after the installation timing point, a total flowing amount EX, a first viscosity change amount ΔV1, and a second viscosity change amount ΔV2. The total flowing amount EX indicates a total flowing amount of ink flowing out through the outlet 66 after the installation timing point until the corresponding use period starts. The first viscosity change amount ΔV1 is an amount of change in the viscosity of the ink flowing through the outlet 66 per unit time (one month) during the corresponding use period. The second viscosity change amount ΔV2 indicates an amount of change in the viscosity of the ink flowing through the outlet 66 per unit flowing amount (1 ml in this embodiment) during the corresponding use period. Although details are described below, in the viscosity estimation processing, any of the first viscosity change amount ΔV1 and the second viscosity change amount ΔV2 is used to estimate the viscosity of the ink flowing through the outlet 66.

The four kinds of reference data 125 are generated based on the viscosity change data acquired by the experiment, simulation, or the like. For example, the PV100 (25° C.) reference data 125*a* indicated in FIG. 4D is generated based on the viscosity change data indicated in FIG. 4A. In the following, the PV100 (25° C.) reference data 125*a* indicated in FIG. 4D is explained in detail. The use period, after n months since the installation timing point and before n+1 months, is determined as a use period n. Namely, a use period 4 indicates a period after four months since the installation timing point until 5 months. The total flowing amount EX, the first viscosity change amount ΔV1, and the second viscosity change amount ΔV2 corresponding to the use period n are referred to as a total flowing amount EX(n), a first viscosity change amount ΔV1(n), and a second viscosity change amount ΔV2(n). An approximate flowing amount per one month when the PV is 100 is referred to as a PV100 fixed amount, and an approximate flowing amount per one month when the PV is 500 is referred to as a PV500 fixed amount.

As described above, the PV100 fixed amount is 4 ml. Thus, the total flowing amount EX(n) corresponding to the use period n is an amount acquired by multiplying 4 ml by n. For example, the total flowing amount EX (9) corresponding to the use period 9 is 36 ml (=4 ml×9).

The first viscosity change amount ΔV1(n) is an amount acquired by subtracting the viscosity of the ink flowing through the outlet 66 at a start point of the corresponding use period n from the viscosity of the ink flowing through the outlet 66 at an end point of the corresponding use period n, and by dividing a value acquired from the subtraction by the unit time. In the PV100 viscosity change data indicated in FIG. 4A, an acquisition interval for the viscosity of the ink flowing through the outlet 66 is one month that is the same as the unit time (the use period). The first viscosity change amount ΔV1 is thus a value, in the PV100 viscosity change data, acquired by subtracting the viscosity at the start point of the corresponding use period from the viscosity at the end point of the corresponding use period. For example, the first viscosity change amount ΔV1(2) corresponding to the use period 2 is a value (0.4 cps/month) acquired by subtracting the viscosity (5.0 cps) in the second month, which is the start point of the use period 2, from the viscosity (5.4 cps) in the third month, which is the end point of the use period 2.

The second viscosity change amount ΔV2(n) is a value acquired by dividing the value acquired from the subtraction related to the corresponding use period n by the PV100 fixed amount (4 ml). For example, the second viscosity change amount ΔV2(2) corresponding to the use period 2 is a value (0.10 cps/ml) acquired by dividing 0.4 cps, which is the value acquired from the subtraction, by 4 ml.

Similarly, the PV 500 (25° C.) reference data 125*b* indicated in FIG. 4E is generated based on the viscosity change data indicated in FIG. 4B. Although details are omitted, the PV100 (40° C.) reference data 125*c* is generated based on the viscosity change data when the PV is fixed to 100 and the temperature in the main tank 30 is fixed to 40° C., and the PV500 (40° C.) reference data 125*d* is generated based on the viscosity change data when the PV is fixed to 500 and the temperature in the main tank 30 is fixed to 40° C.

In the following, the viscosity estimation processing executed by the CPU 101 for each predefined time (one month) is explained in detail. In the viscosity estimation processing, the CPU 101 estimates a viscosity change amount ΔVc of the ink flowing through the outlet 66 from the reference timing point which is one of the installation timing point and the timing point for most-recent execution of the viscosity estimation processing, whichever is later. Then, the CPU 101 estimates a viscosity acquired by cumulatively adding the viscosity change amount ΔVc estimated to the viscosity indicated by the outlet viscosity information 124, as a current viscosity V of ink flowing through the outlet 66.

In the following, an alphabetic suffix (a) is added appropriately to a data name related to a timing point for the a-th execution of the viscosity estimation processing after the installation timing point. For example, as described later, a total flowing amount Q at the timing point for the a-th execution of the viscosity estimation processing is referred to as a total flowing amount Q(a). A value of the (a) is one at the timing point for the first execution of the viscosity estimation processing after the installation timing point, from this point forward, one is added to the (a) value for each execution point of the viscosity estimation processing.

In the a-th viscosity estimation processing, the CPU 101 acquires a value indicated by the count information of the total-flowing-amount count information 121, as the total flowing amount Q(a). Further, the CPU 101 acquires, based on the most-recent flowing amount count information 122, the total flowing amount Q at the reference timing point, as a total flowing amount Q(a−1). Then, as indicated by the following equation (1), a value acquired by subtracting the total flowing amount Q(a−1) from the total flowing amount Q(a) is calculated as a flowing amount ΔQ(a) of ink flowing out through the outlet 66 after the reference timing point per unit time (one month).

$$\Delta Q(a)=Q(a)-Q(a-1) \tag{1}$$

The CPU 101 acquires, from the temperature history information 123, a temperature temp(a) that is an average temperature after the reference timing point until a current timing point.

The CPU 101 estimates a current viscosity change amount ΔVc(a) by performing interpolation, based on the viscosity change amount estimated based on each piece of reference data 125, the flowing amount ΔQ(a) acquired, and the temperature temp(a) acquired. Here, the viscosity increasing period after the installation timing point until the viscosity of the ink flowing through the outlet 66 reaches the peak value is different in the estimation method of the viscosity change amount ΔVc(a) from the viscosity decreasing period after reaching the peak value. In the following, the estimation methods for the respective periods are explained in detail.

At first, the viscosity estimation processing executed in the viscosity increasing period is explained. As described above, in the viscosity increasing period, the influence of the increase in viscosity due to the pigment fall with time is greater than the influence of the decrease in viscosity due to the flowing out of ink through the outlet 66. Thus, using the first viscosity change amount ΔV1, which is the viscosity change amount per unit time in each piece of reference data 125, makes estimation accuracy higher than using the second viscosity change amount ΔV2, which is the viscosity change amount per unit flowing amount in each piece of reference data 125. The first viscosity change amount ΔV1 is thus used to estimate the viscosity in the viscosity increasing period.

The CPU 101 extracts, from each piece of reference data 125, the first viscosity change amount ΔV1 corresponding to the total flowing amount Q(a) acquired, as a first change amount ΔVis(a).

Specifically, the CPU 101 extracts, as the viscosity change amount ΔVis(a), the first viscosity change amount ΔV1 corresponding to the use period of the total flowing amount EX that is equal to or less than the total flowing amount Q(a)

and is closest to the total flowing amount Q(a) of the total flowing amounts EX included in the reference data 125. For example, when the total flowing amount Q(a) is 38 ml, the CPU 101 extracts, from the PV100 (25° C.) reference data 125*a*, 0.2 cps/month that is the first viscosity change amount ΔV1 corresponding to the use period 9, as the viscosity change amount ΔVis(a). Further, the CPU 101 extracts, from the PV500 (25° C.) reference data 125*b*, −0.1 cps/month that is the first viscosity change amount ΔV1 corresponding to the use period 2, as the viscosity change amount ΔVis(a).

In the following, a suffix 25 representing 25° C. is added to a data name of data related to a temperature of 25° C., and a suffix 40 representing 40° C. is added to a data name of data related to a temperature of 40° C. Further, regarding data related to the PV100, a suffix_100 is further added to the above suffix related to the temperature, and regarding data related to the PV500, a suffix_500 is further added to the above suffix related to the temperature. For example, the viscosity change amount ΔVis25_100(a) indicates the viscosity change amount ΔVis(a) related to a temperature of 25° C. and the PV100.

After that, the CPU 101 estimates the viscosity change amount ΔVis25(a) corresponding to the flowing amount ΔQ(a) at a temperature of 25° C., by using the following equation (2). Namely, the CPU 101 estimates the viscosity change amount ΔVis25(a) by performing proportional distribution (linear interpolation) based on the ΔVis25_100(a), the ΔVis25_500(a), the PV100 fixed amount (4 ml), and the PV500 fixed amount (18 ml).

$$\Delta Vis25(a)=\Delta Vis25_100(a)+(\Delta Vis25_500(a)-\Delta Vis25_100(a))/(18-4)\times(\Delta Q(a)-4) \quad (2)$$

For example, when ΔVis25_100(a) is 0.2, ΔVis25_500(a) is −0.1, and ΔQ(a) is 7, ΔVis25(a) is 0.14 (=0.2+(−0.1−0.2)/(18−4)×(7−4)).

Similarly, the CPU 101 estimates the viscosity change amount ΔVis40(a) corresponding to the flowing amount ΔQ(a) at a temperature of 40° C. by the following equation (3).

$$\Delta Vis40(a)=\Delta Vis40_100(a)+(\Delta Vis40_500(a)-\Delta Vis40_100(a))/(18-4)\times(\Delta Q(a)-4) \quad (3)$$

As understood from the equations (2) and (3), when the current flowing amount ΔQ(a) is equal to 4 ml that is the PV100 fixed amount, values of the ΔVis25_100(a) and the ΔVis40_100(a) extracted from the pieces of reference data 125*a* and 125*c* related to the PV100 are values of the ΔVis25(a) and the ΔVis40(a), respectively. Similarly, when the current flowing amount ΔQ is equal to 18 ml that is the PV500 fixed amount, values of ΔVis25_500(a) and ΔVis40_500(a) extracted from the pieces of reference data 125*b* and 125*d* related to the PV500 are values of the ΔVis25(a) and the ΔVis40(a), respectively. In view of the above, in this embodiment, when the current flowing amount ΔQ is equal to any of the PV100 fixed amount and the PV500 fixed amount, the ΔVis(a) is not extracted from each of the four kinds of reference data 125, but the ΔVis(a) is extracted only from each of the two kinds of reference data 125 having the fixed amount equal to the flowing amount ΔQ.

Next, the CPU 101 estimates, based on the ΔVis25(a) and the ΔVis40(a), the viscosity change amount ΔVc(a) corresponding to the temperature temp(a) acquired, by using the following equation (4). Namely, the CPU 101 estimates the viscosity change amount ΔVc(a) by performing proportional distribution based on the ΔVis25(a), the ΔVis40(a), a temperature of 25° C., and a temperature of 40° C.

$$\Delta Vc(a)=\Delta Vis25(a)+(\Delta Vis40(a)-\Delta Vis25(a))/(40-25)\times(temp(a)-25) \quad (4)$$

For example, when the ΔVis25(a) is 0.14, the ΔVis40(a) is 0.21, and the temp(a) is 30° C., the ΔVc(a) is 0.16 (=0.14+(0.21−0.14)/(40−25)×(30−25)).

The CPU 101 adds, to the viscosity of the outlet viscosity information 124, the viscosity change amount ΔVc(a) as a viscosity change amount of ink flowing through the outlet 66 after the reference timing point until the current timing point. This updates the viscosity indicated by the outlet viscosity information 124. More specifically, as indicated by the following equation (5), the CPU 101 estimates a value acquired by adding the viscosity change amount ΔVc(a) estimated to a viscosity V(a−1) of ink flowing through the outlet 66 at the reference timing point (a latest viscosity V(a−1) indicated by the outlet viscosity information 124 before a current viscosity estimation processing is executed), as a viscosity V(a) of ink flowing through the outlet 66 at the time of execution of the current viscosity estimation processing.

$$V(a)=V(a-1)+\Delta Vc(a) \quad (5)$$

Thus, the viscosity V(a) indicated by the outlet viscosity information 124 is a value acquired by cumulatively adding the viscosity change amount ΔVc estimated by the viscosity estimation processing executed after the installation timing point to 4.0 cps that is the initial viscosity.

As described above, it is possible to accurately estimate the viscosity of the ink flowing through the outlet 66 during the viscosity increasing period. Subsequently, the viscosity estimation processing executed during the viscosity decreasing period is explained. In the viscosity decreasing period, the influence of the decrease in viscosity due to the flowing out of ink through the outlet 66 is greater than the influence of the increase in viscosity due to the pigment fall with time. Thus, using the second viscosity change amount ΔV2, which is the viscosity change amount per unit flowing amount in each piece of reference data 125, makes estimation accuracy higher than using the first viscosity change amount ΔV1, which is the viscosity change amount per unit time in each piece of reference data 125. Thus, during the viscosity decreasing period, the second viscosity change amount ΔV2 is used to estimate the viscosity.

At first, the CPU 101 extracts, from each piece of reference data 125, the second viscosity change amount ΔV2 at the reference timing point that is the timing point for most-recent execution of the viscosity estimation processing, as ΔVde(a−1). Specifically, the CPU 101 extracts, as the viscosity change amount ΔVde(a−1), the second viscosity change amount ΔV2 corresponding to the use period of the total flowing amount EX that is equal to or less than the total flowing amount Q(a−1) and closest to the total flowing amount Q(a−1) of the total flowing amounts EX included in the reference data 125. For example, when the total flowing amount Q(a−1) at the reference timing point is 47 ml, the CPU 101 extracts, from the PV100 (25° C.) reference data 125*a*, −0.03 cps/ml that is the second viscosity change amount ΔV2 corresponding to the use period 11, as the viscosity change amount ΔVde25_100(a−1). Further, the CPU 101 extracts, from the PV500 (25° C.) reference data 125*b*, −0.03 cps/ml that is the second viscosity change amount ΔV2 corresponding to the use period 2, as the viscosity change amount ΔVde25_500(a−1).

In this embodiment, it is assumed that the pieces of ΔVde(a−1) acquired are flowing amounts per unit time after the reference timing point until the current timing point. Thus, as indicated by the following equation (6), four viscosity change amounts ΔVei(a) for the four kinds of reference data 125 can be acquired by multiplying the four kinds of ΔVde(a−1) respectively extracted from the four kinds of reference data 125 by the flowing amount ΔQ(a) acquired. Each of the four viscosity change amounts ΔVei(a) is the viscosity change amount of ink flowing through the outlet 66 estimated based on each piece of reference data 125 after the reference timing point until the current timing point.

$$\Delta Vei(a)=\Delta Vde(a-1)\times\Delta Q(a) \quad (6)$$

Thus, similar to the viscosity estimation method for the viscosity increasing period, the viscosity change amount corresponding to the flowing amount ΔQ(a) and the temperature temp(a) acquired can be estimated by performing interpolation for the flowing amount per unit time and interpolation for the temperature by use of the four viscosity change amounts ΔVei(a). The viscosity change amount estimated, however, may be different from an actual viscosity change amount. The reason thereof is described below:

As understood from FIG. 4C, the peak value of viscosity of the ink flowing through the outlet 66 is not constant. Thus, unlike the viscosity increasing period, the viscosity of the ink flowing through the outlet 66 is not constant at a start point of the viscosity decreasing period. Meanwhile, the viscosity of the ink flowing through the outlet 66 when the main tank 30 has become empty is a value lower than 4.0 cps that is the initial value.

Figure 5A:
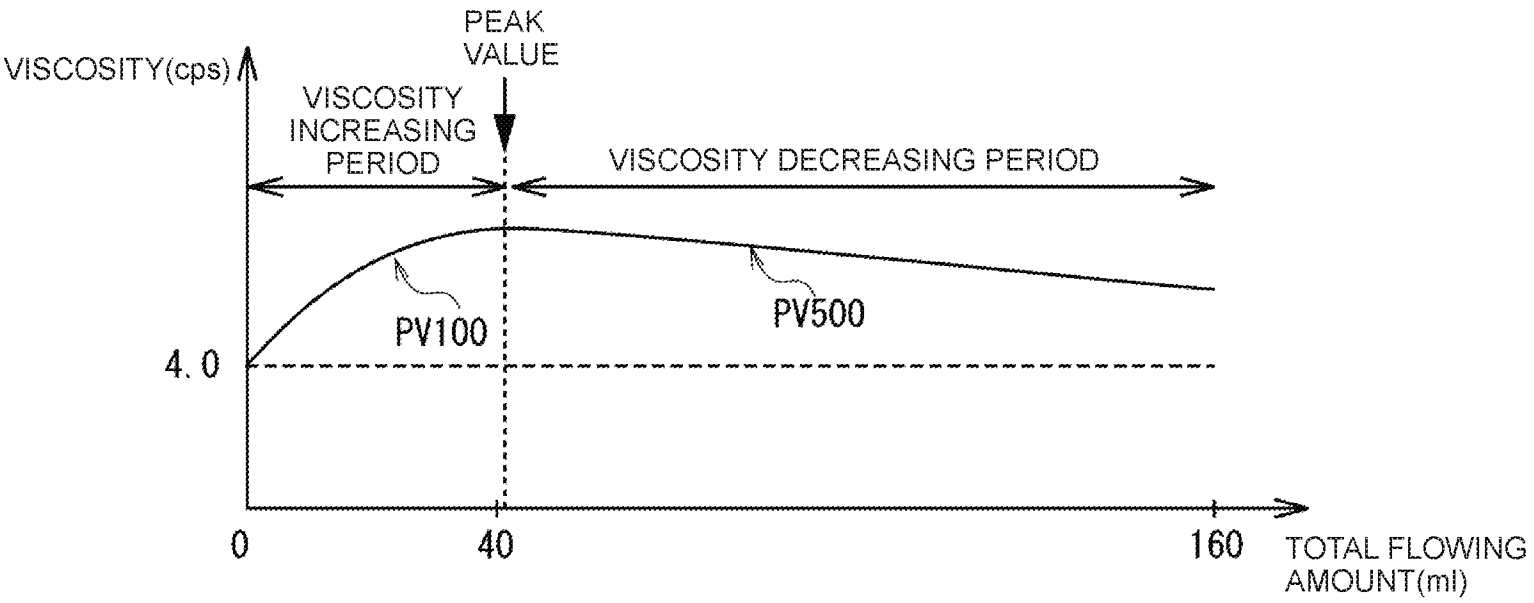
FIGS. 5A and 5B each illustrate correction of a viscosity change amount.

For example, as depicted in FIG. 5A, when the PV100 fixed amount of ink flows out from the outlet 66 per unit time during the viscosity increasing period, the peak value of viscosity of the ink flowing through the outlet 66 is approximately 8.2 cps. After that, when the PV500 fixed amount of ink flows out from the outlet 66 per unit time during the viscosity decreasing period, the viscosity change amount ΔVei(a) is estimated in the viscosity estimation processing only based on the second viscosity change amounts ΔV2 of the pieces of reference data 125*b* and 125*d* related to the PV500. As a result, the viscosity change amount ΔVei(a) estimated is smaller than the actual viscosity change amount.

Figure 5B:
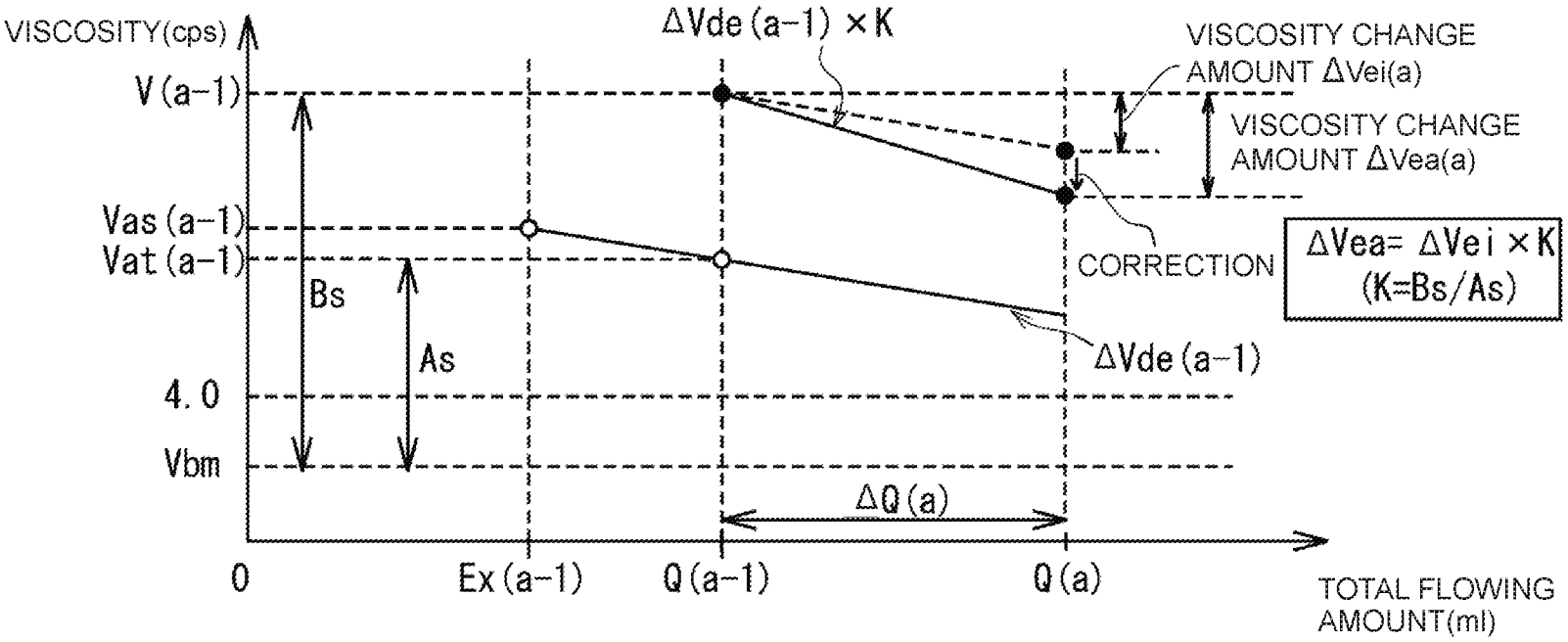

In order to solve that problem, in this embodiment, lower-limit viscosity data 126, which indicates a lower-limit viscosity Bm of the ink flowing through the outlet 66, is stored in the non-volatile memory 104. In the viscosity estimation processing for the viscosity decreasing period, as depicted in FIG. 5B, the CPU 101 multiplies the viscosity change amount ΔVei(a) estimated by a predefined correction coefficient K so that a viscosity V of ink flowing through the outlet 66 that is estimated by each piece of viscosity estimation processing after the current processing is converged on the lower-limit viscosity Bm.

Calculation processing of the correction coefficient K is explained below. The calculation processing of the correction efficient K is performed for each of the four kinds of reference data 125. The calculation processing is common in the four kinds of reference data 125 except for the reference data 125 to be referred. The explanation is thus made without distinguishing the four kinds of reference data 125 from each other.

At first, the CPU 101 extracts a total flowing amount EX(a−1) that is equal to or less than the total flowing amount Q(a−1) at the reference timing point and closest to the total flowing amount Q(a−1), of the total flowing amounts EX included in the reference data 125.

After that, the CPU 101 calculates, based on the reference data 125, a viscosity Vas(a−1) of ink flowing through the outlet 66 that corresponds to the total flowing amount EX(a−1) extracted. Specifically, the CPU 101 calculates a total amount ΣΔV1 (a−1) of the first viscosity change amount ΔV1 after the installation timing point until the use period related to the total flowing amount EX(a−1). Then, as indicated by the following equation (7), a value acquired by adding 4.0 cps that is the initial viscosity to the total amount ΣΔV1(a−1) is calculated as the viscosity Vas(a−1).

$$Vas(a-1)=4.0+\Sigma\Delta V1(a-1) \quad (7)$$

Then, the CPU 101 estimates a viscosity Vat(a−1) of ink flowing through the outlet 66 at the reference timing point, assuming that the viscosity change amount per unit flowing amount is the ΔVde(a−1) during a period after a timing point at which the total flowing amount of ink flowing out through the outlet 66 is the EX(a−1) until a timing point at which the total flowing amount of ink flowing out through the outlet 66 becomes Q(a−1). Namely, as indicated by the following equation (8), the CPU 101 estimates the viscosity change amount ΔVde(a−1) based on the viscosity Vas(a−1), the viscosity change amount ΔVde(a−1), the total flowing amount Q(a−1), and the total flowing amount EX(a−1).

$$Vat(a-1)=Vas(a-1)+\Delta Vde(a-1)\times(Q(a-1)-Ex(a-1)) \quad (8)$$

The viscosity Vat(a−1) indicates the viscosity corresponding to the total flowing amount EX(a−1) in the estimated change in the viscosity of the ink flowing through the outlet 66 indicated by the reference data 125. For example, the viscosity Vat(a−1) estimated based on the PV100 (25° C.) reference data 125*a* indicates the viscosity at the timing point at which the total flowing amount of ink flowing out through the outlet 66 is the total flowing amount EX(a−1) on condition that the temperature is fixed to 25° C. and the flowing amount per unit time is fixed to the PV100 fixed amount.

After that, as indicated by the following equations (9) and (10), the CPU 101 calculates a difference As between the viscosity Vat(a−1) and a lower-limit viscosity Vbm and a difference Bs between the estimated viscosity V(a−1) of ink flowing through the outlet 66 at the reference timing point and the lower-limit viscosity Vbm.

$$As=Vat(a-1)-Vbm \quad (9)$$

$$Bs=V(a-1)-Vbm \quad (10)$$

Then, as depicted by the following equation (11), a value acquired by dividing the difference Bs by the difference As is determined as the correction coefficient K.

$$K=Bs/As \quad (11)$$

As described above, the correction coefficient K is calculated. Then, as indicated by the following equation (12), the CPU 101 calculates a viscosity change amount ΔVea(a) by multiplying the viscosity change amount ΔVei(a) by the correction coefficient K.

$$\Delta Vea(a)=\Delta Vei(a)\times K \quad (12)$$

Four kinds of the ΔVea(a), including ΔVea25_100(a), ΔVea25_500(a), ΔVea40_100(a), and ΔVea40_500(a), are present corresponding to the four kinds of reference data 125.

In subsequent processing, the CPU 101 estimates, similarly to the viscosity increasing period, the viscosity change amount ΔVc(a) corresponding to the flowing amount ΔQ(a) and the temperature temp(a) acquired by performing interpolation for the flowing amount per unit time and interpolation for the temperature by use of the four viscosity change amounts ΔVea(a).

Namely, the viscosity change amount ΔVea25(a) at a temperature of 25° C. is estimated by the following equation (13), and the viscosity change amount ΔVea40(a) at a temperature of 40° C. is estimated by the following equation (14).

$$\Delta Vea25(a)=\Delta Vea25_100(a)+(\Delta Vea25_500(a)-\Delta Vea25_100(a))/(18-4)\times(\Delta Q(a)-4) \quad (13)$$

$$\Delta Vea40(a)=\Delta Vea40_100(a)+(\Delta Vea40_500(a)-\Delta Vea40_100(a))(18-4)\times(\Delta Q(a)-4) \quad (14)$$

Then, the viscosity change amount ΔVc(a) is estimated by the following equation (15) by use of the ΔVea25(a) and the ΔVea40(a).

$$\Delta Vc(a)=\Delta Vea25(a)+(\Delta Vea40(a)-\Delta Vea25(a))/(40-25)\times(\text{temp}(a)-25) \quad (15)$$

As described above, also during the viscosity decreasing period, it is possible to accurately estimate the viscosity of the ink flowing through the outlet 66. Similar to the viscosity estimation processing during the viscosity increasing period, also in the viscosity estimation processing during the viscosity decreasing period, when the current flowing amount ΔQ is equal to any of the PV100 fixed amount and the PV500 fixed amount, the ΔVea(a) is not estimated based on each of the four kinds of reference data 125, but the ΔVea(a) is estimated only based on each of the two kinds of reference data 125 having the fixed amount equal to the flowing amount ΔQ.

Figure 6A:
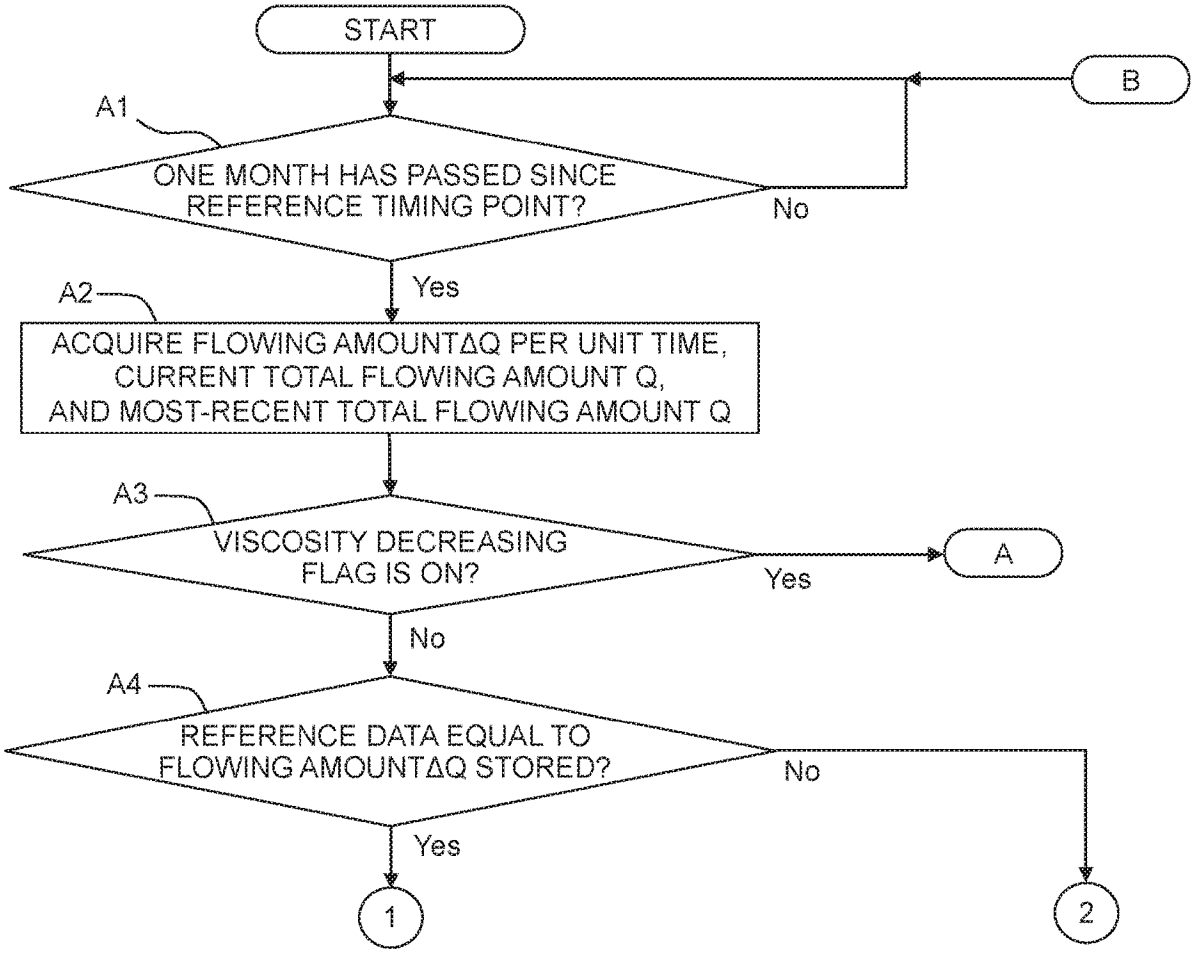
FIGS. 6A to 6C are a flowchart of viscosity estimation processing.
Figure 6B:
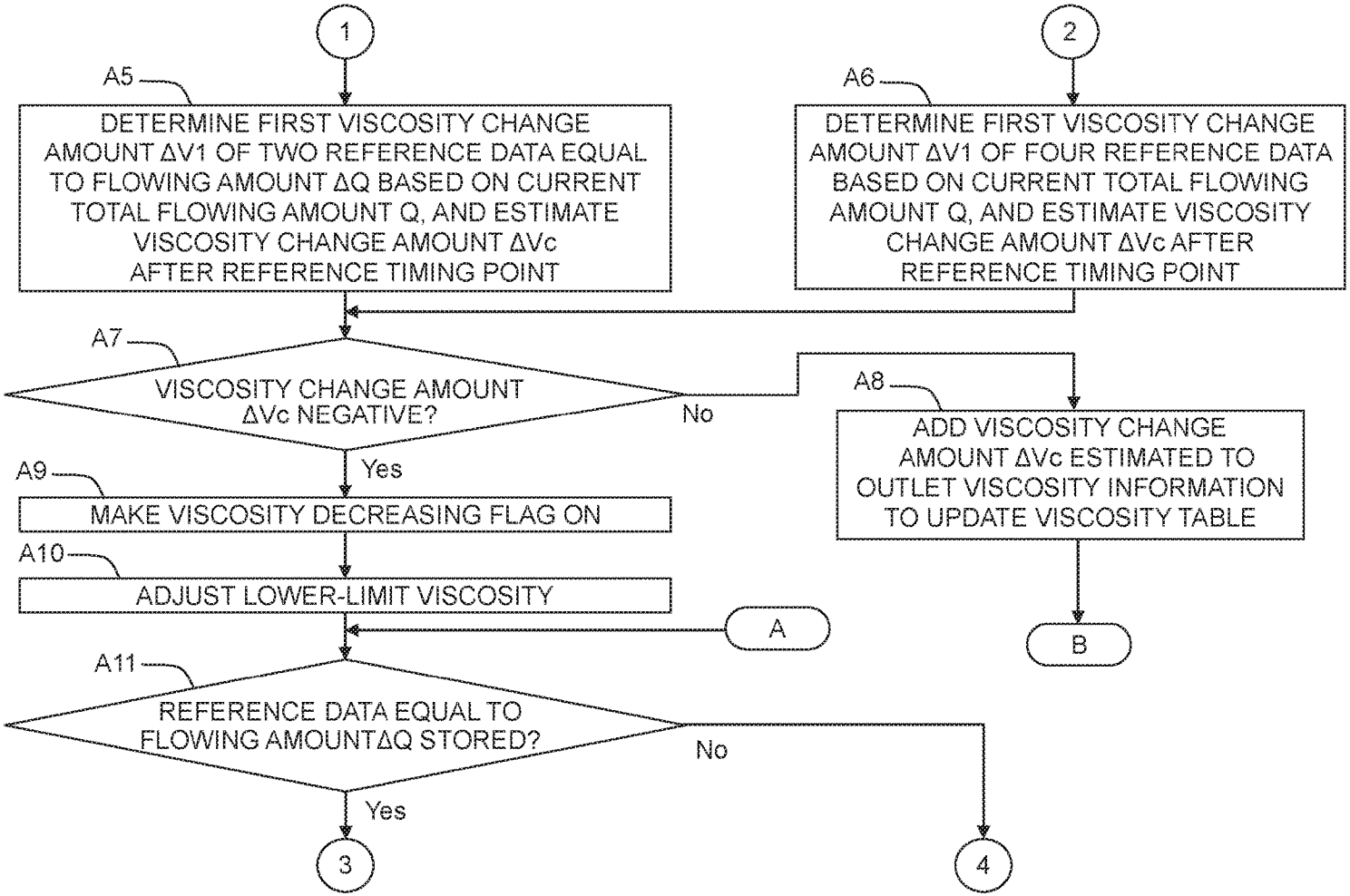
Figure 6C:
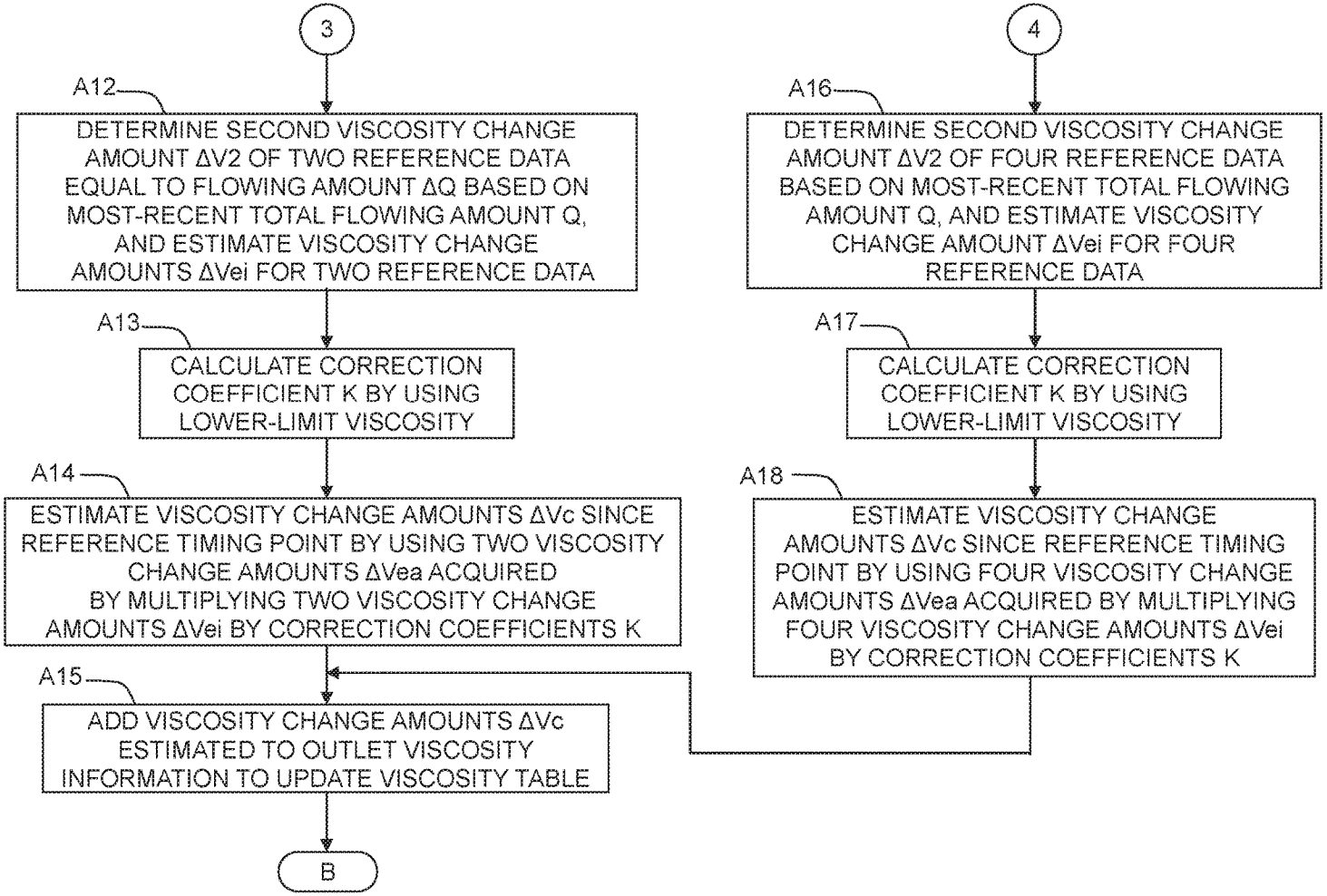

Subsequently, referring to FIGS. 6A to 6C, a series of processing operation of the printer 1 related to the viscosity estimation processing is explained.

At first, the CPU 101 determines whether one month has passed since the reference timing point (A1). When the CPU 101 has determined that one month has passed (A1: YES), the CPU 101 refers to the total-flowing-amount count information 121 and the most-recent flowing amount count information 122 stored in the non-volatile memory 104 to acquire the flowing amount ΔQ(a) per unit time, the total flowing amount Q(a) at the timing point for execution of the current viscosity estimation processing, and the total flowing amount Q(a−1) at the reference timing point (A2). In the A2 processing, the CPU 101 further acquires the temperature temp(a) based on the temperature history information 123.

Then, the CPU 101 determines whether a viscosity decreasing flag 127 stored in the non-volatile memory 104 is in an on state (A3). The viscosity decreasing flag 127 is in an off state when the current timing point is included in the viscosity increasing period, and the viscosity decreasing flag 127 is in the on state when the current timing point is included in the viscosity decreasing period. When the CPU 101 has determined that the viscosity decreasing flag 127 is in the on state (A3: YES), the CPU 101 proceeds to A11 processing.

When the CPU 101 has determined that the viscosity decreasing flag 127 is in the off state (A3: NO), the CPU 101 determines whether the reference data 125 having the fixed amount equal to the flowing amount ΔQ(a) acquired is stored in the non-volatile memory 104 (A4). When the CPU 101 has determined that the reference data 125 having the fixed amount equal to the flowing amount ΔQ(a) is stored in the non-volatile memory 104 (A4: YES), the CPU 101 determines the first viscosity change amount ΔV1 corresponding to the total flowing amount Q(a), based on two kinds of reference data 125 having the fixed amount equal to the flowing amount ΔQ(a). Then, the CPU 101 estimates the viscosity change amount ΔVC of ink flowing through the outlet 66 after the reference timing point by use of the first viscosity change amount ΔV1, the temperature temp(a), the flowing amount ΔQ(a), and the like (A5). When the CPU 101 has determined that the reference data 125 having the fixed amount equal to the flowing amount ΔQ(a) is not stored in the non-volatile memory 104 (A4: NO), the CPU 101 determines the first viscosity change amount ΔV1 corresponding to the total flowing amount Q(a) based on the four kinds of reference data 125. Then, the CPU 101 estimates the viscosity change amount ΔVC of ink flowing through the outlet 66 after the reference timing point by use of the first viscosity change amount ΔV1, the temperature temp(a), the flowing amount ΔQ(a), and the like (A6).

After the A5 processing or A6 processing, the CPU 101 determines whether a value of the viscosity change amount ΔVc estimated is negative (A7). When the CPU 101 has determined that the value of the viscosity change amount ΔVc is not negative (A7: NO), the CPU 101 determines that the current timing point is included in the viscosity increasing period, and then adds the viscosity change amount ΔVc estimated in the A6 processing to the viscosity indicated by the outlet viscosity information 124 (A5). This updates the viscosity indicated by the outlet viscosity information 124. In the A8 processing, the viscosity V(a), to which the viscosity change amount ΔVc has been added, indicated by the outlet viscosity information 124 is mapped to the total flowing amount Q(a), and they are stored in a viscosity table 128 of the non-volatile memory 104. The viscosity table 128 is a table in which the viscosity V estimated by each piece of viscosity estimation processing executed after the installation timing point is mapped to the count value of the total-flowing-amount count information 121 at the time of each piece of viscosity estimation processing. After the A8 processing, the CPU 101 returns to the A1 processing.

When the CPU 101 has determined that the value of the viscosity change amount ΔVc is negative (A7: YES), the CPU 101 determines that the current timing point is included in the viscosity decreasing period, and changes the viscosity decreasing flag 127 stored in the non-volatile memory 104 from the off state to the on state (A9). Subsequently, the CPU 101 determines that the current viscosity indicated by the outlet viscosity information 124 is the peak value, and adjusts a value of the lower-limit viscosity Vbm indicated by the lower-limit viscosity data 126 of the non-volatile memory 104 (A10). Specifically, the final viscosity of the ink flowing through the outlet 66 when the main tank 30 becomes empty is lower, as the peak value is greater. The CPU 101 thus adjusts so that the lower-limit viscosity Vbm is smaller as the peak value is greater. This improves estimation accuracy of the viscosity change amount ΔVc. After completing the A10 processing, the CPU 101 proceeds to the A11 processing.

In the A11 processing, the CPU 101 determines whether the reference data 125 having the fixed amount equal to the flowing amount ΔQ(a) acquired in the A2 processing, is stored in the non-volatile memory 104. When the CPU 101 has determined that the reference data 125 having the fixed amount equal to the flowing amount ΔQ(a) is stored in the non-volatile memory 104 (A11: YES), the CPU 101 determines the second viscosity change amount ΔV2 corresponding to the total flowing amount Q(a−1) based on two kinds of reference data 125 having the fixed amount equal to the flowing amount ΔQ(a), and estimates the viscosity change amount ΔVei(a) for each of the two kinds of reference data 125 by use of the second viscosity change amount ΔV2, the flowing amount ΔQ(a), and the like (A12). Further, the CPU 101 calculates two viscosities Vat(a−1) respectively based on the two kinds of reference data 125, and calculates two correction coefficients K based on the two viscosities Vat (a−1), the viscosity V(a−1) indicated by the outlet viscosity information 124, and the lower-limit viscosity Vbm indicated by the lower-limit viscosity data 126 (A13). After that, the CPU 101 calculates two viscosity change amounts ΔVea(a) by multiplying the viscosity change amounts ΔVei for the two kinds of reference data 125 by the correction coefficients K corresponding thereto, and estimates viscosity change amounts ΔVc(a) by performing interpolation for the temperature on the two viscosity change amounts ΔVea(a) (A14). The viscosity change amounts ΔVc(a) estimated in the A14 processing are added to the viscosity indicated by the outlet viscosity information 124 (A15). In the A15 processing, the viscosity V(a) indicated by the outlet viscosity information 124 is mapped to the total flowing amount Q(a) acquired, and they are stored in the viscosity table 128. After completing the A15 processing, the CPU 101 returns to the A1 processing.

When the CPU 101 has determined in the A11 processing that the reference data 125 having the fixed amount equal to the flowing amount ΔQ(a) is not stored in the non-volatile memory 104 (A11: NO), the CPU 101 determines the second viscosity change amount ΔV2 corresponding to the total flowing amount Q(a−1) based on the four kinds of reference data 125, and estimates the viscosity change amount ΔVei(a) for each of the four kinds of reference data 125 by use of the second viscosity change amount ΔV2, the flowing amount ΔQ(a), and the like (A16). Further, the CPU 101 calculates four viscosities Vat(a−1) based on the four kinds of reference data 125, and calculates four correction coefficients K based on the four viscosities Vat(a−1), the viscosity V(a−1) indicated by the outlet viscosity information 124, and the lower-limit viscosity Vbm indicated by the lower-limit viscosity data 126 (A17). After that, the CPU 101 calculates four viscosity change amounts ΔVea(a) by multiplying the viscosity change amounts ΔVei for the four kinds of reference data 125 by the respective correction coefficients K corresponding thereto, and estimates viscosity change amounts ΔVc(a) by performing interpolation for the flowing amount per unit time and interpolation for the temperature on the four viscosity change amounts ΔVc(a) (A18). After completing the A18 processing, the CPU 101 returns to the A15 processing in which the viscosity change amounts ΔVc(a) estimated in the A18 processing are added to the viscosity indicated by the outlet viscosity information 124.

Figure 7:
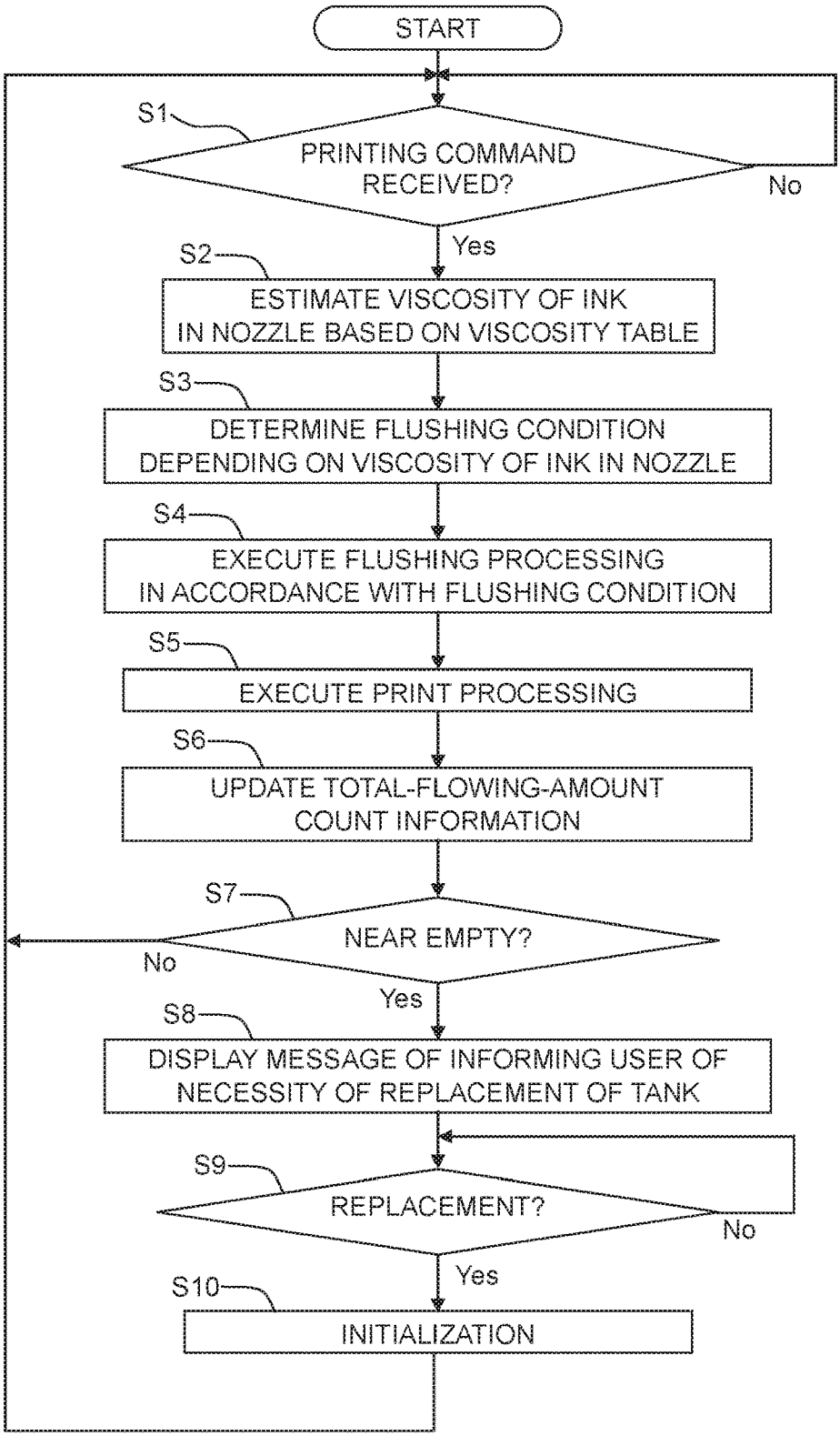
FIG. 7 is a flowchart of operations of the ink-jet printer.

Next, referring to FIG. 7, an exemplary processing operation of the printer 1 is explained. The following is an explanation about an embodiment in which the actuator 45 performs the flushing as the discharge processing after a printing command is received and before the print processing is executed. The present teaching, however, is not limited to that embodiment. An embodiment in which the purge unit 9 performs the suction purge as the discharge processing may be adopted.

At first, the CPU 101 determines whether a printing command from the external apparatus 200 is received (S1). When the CPU 101 has determined that the printing command is received (S1: YES), the CPU 101 estimates the viscosity of the ink in the nozzle 46 based on the viscosity table 128 and the current total flowing amount indicated by the total-flowing-amount count information 121 (S2). Specifically, the CPU 101 calculates a subtraction amount acquired by subtracting a channel capacity of an ink channel ranging from the outlet 66 to the nozzle 46 from the current total flowing amount indicated by the total-flowing-amount count information 121. Then, a viscosity (a viscosity at the time of flowing out) mapped to the total flowing amount that is closest to that subtraction amount in the viscosity table 128 is estimated as a current ink viscosity in the nozzle 46. Or, the CPU 101 may estimate a ink-viscosity increasing amount due to drying in the ink channel ranging from the outlet 66 to the nozzle 46, and may estimate a viscosity acquired by adding the ink-viscosity increasing amount to the viscosity at the time of flowing out, as the current ink viscosity in the nozzle 46.

Next, the CPU 101 determines, depending on the viscosity of the ink in the nozzle 46 estimated, a drive condition (flushing condition) of the actuator 45 when the flushing is performed (S3). Then, the CPU 101 executes flushing processing in which the actuator 45 performs the flushing in accordance with the flushing condition determined (S4). After that, the CPU 101 controls the carriage drive motor 20, the head 4, and the like to execute the print processing in which an image is printed on a sheet P in accordance with the printing command from the external apparatus 200 (S5). Next, the CPU 101 calculates a consumption amount of ink jetted or discharged from each nozzle 46 after the printing command is received in the S1 processing until the print processing related to the printing command is completed, and adds the consumption amount calculated, as the flowing amount of ink flowing out through the outlet 66, to the count value of the total-flowing-amount count information 121 (S6).

Next, the CPU 101 determines whether a liquid surface of ink in the sub tank 6 is in the near empty state that is less than the detection position based on the output result from the remaining-amount detection sensor 120 (S7). When the CPU 101 has determined that the liquid surface is not in the near empty state (S7: NO), the CPU 101 returns to the S processing. When the CPU 101 has determined that the liquid surface is in the near empty state (S7: YES), the CPU 101 displays the message of informing the user of the necessity of replacement of the main tank 30 on the touch panel 161 (S8). When the CPU 101 has determined based on the detection result of the installation detection sensor 130 that the user has installed a new main tank 30 in the tank installation section 5 for tank replacement (S9: YES), the CPU 101 initializes the total-flowing-amount count information 121, most-recent flowing amount count information 122, temperature history information 123, outlet viscosity information 124, lower-limit viscosity data 126, viscosity decreasing flag 127, viscosity table 128, and the like, those of which are stored in the non-volatile memory 104 (S10). With this, for example, the viscosity indicated by the outlet viscosity information 124 is initialized to 4.0 cps that is the initial viscosity. After completing the S10 processing, the CPU 101 returns to the S1 processing.

In this embodiment, the fixed amount of the reference data 125*a* and 125*c* related to the PV100 is different from that of the reference data 125*b* and 125*d* related to the PV500. This makes it possible to estimate the viscosity of the ink flowing through the outlet 66 corresponding to the flowing amount ΔQ acquired, based on the flowing amount ΔQ acquired, the total flowing amount Q, and the pieces of reference data 125.

In the above embodiment, a combination of the main tank 30 and the sub tank 6 corresponds to a liquid tank. The main tank 30 corresponds to a first storage chamber, and the sub tank 6 corresponds to a second storage chamber. The outlet 66 corresponds to a supply port. The non-volatile memory 104 corresponds to a memory. The CPU 101 corresponds to a controller. The flowing amount ΔQ corresponds to a supply amount per unit time, and the total flowing amount Q corresponds to a cumulative supply amount. The reference data 125*a* and 125*c* correspond to first reference data, and the reference data 125*b* and 125*d* correspond to second reference data. The viscosity change amount ΔVc(a) estimated by the viscosity estimation processing executed during the viscosity increasing period corresponds to a first change amount. The viscosity change amount ΔVde(a−1) estimated by the viscosity estimation processing executed during the viscosity decreasing period corresponds to a second change amount. The purge unit 9 and the actuator 45 of the head 4 correspond to a liquid discharge unit.

In the above description, the embodiment of the present teaching has been explained. The present teaching, however, is not limited to the embodiment. Various changes or modifications are possible without departing from the description of the appended claims. For example, the ink stored in each main tank 30 is not required to be the pigment ink, and may be, for example, a dye ink. In a case of using the dye ink, water or moisture in the ink evaporates with time while the ink is stayed in the main tank 30 and the sub tank 6, gradually increasing its viscosity. This changes the viscosity of the ink flowing through the outlet 66. Thus, similar to the above embodiment, four kinds of reference data are stored in the non-volatile memory 104. Using the four kinds of reference data and the flowing amount ΔQ acquired in the viscosity estimation processing allows the CPU 101 to accurately estimate the viscosity of the ink flowing through the outlet 66.

In the above embodiment, the four kinds of reference data 125 are stored in the non-volatile memory 104. The present teaching, however, is not limited thereto. At least two kinds of reference data having mutually different fixed amounts are only required to be stored in the non-volatile memory 104. For example, only the PV100 (25° C.) reference data 125*a* and the PV500 (25° C.) reference data 125*b* in the same temperature may be stored in the non-volatile memory 104. Although the reference data 125 is the data indicating the corresponding relation between the total flowing amount EX, the first viscosity change amount ΔV1, and the second viscosity amount ΔV2 in the above embodiment, the present teaching, however, is not limited thereto. The reference data 125 is only required to be data related to the estimated change in the viscosity of the ink flowing through the outlet 66. Thus, for example, the reference data 125 may be data indicating the relation between the elapsed month and the viscosity of the ink flowing through the outlet 66, as depicted in FIG. 4A and the like. In that case also, since the corresponding relation between the total flowing amount EX, the first viscosity change amount ΔV1, and the second viscosity change mount ΔV2 can be calculated based on that reference data, it is possible to estimate the viscosity of the ink flowing through the outlet 66 similarly to the above embodiment.

In the above embodiment, the lower-limit viscosity Vbm of the lower-limit viscosity data 126 is adjusted depending on the peak value that is the highest viscosity among the viscosities estimated in the viscosity estimation processing. The lower-limit viscosity Vbm, however, may be fixed without such adjustment. Further, in the viscosity estimation processing executed during the viscosity decreasing period, the viscosity change amount ΔVc may be estimated based on the viscosity change amount ΔVei(a) without multiplying the viscosity change amount ΔVei(a) estimated by the correction coefficient K. For example, when the pigment ink stored in the main tank 30 is an ink that has small and light pigment particles and has a small content of the pigment particles, a falling amount of the pigment is small and thus the peak value of the viscosity of the ink flowing through the outlet 66 does not become so large. In that case, it is not necessarily to correct the viscosity change amount ΔVei(a) with the correction coefficient K.

The calculation order for estimating the viscosity of the ink flowing through the outlet 66 is not limited to the calculation order in the above embodiment. For example, in the above embodiment, the interpolation for the flowing amount per unit time and the interpolation for the temperature are performed on the four viscosity change amounts estimated respectively based on the four kinds of reference data 125. The interpolation, however, may be performed on four viscosities acquired by adding the viscosity of the ink flowing through the outlet 66 at the reference timing point to the four viscosity change amounts.

In the viscosity estimation processing of the above embodiment, the viscosity of the ink flowing through the outlet 66 of the sub tank 6 is estimated. The present teaching, however, is not limited thereto. It may be configured to estimate the viscosity of the ink in a predefined area of the main tank 30 or the viscosity of the ink in a predefined area of the sub tank 6. In that case, the reference data stored in the non-volatile memory 104 is required to be reference data related to estimated change in the viscosity of the ink in the area estimated. Further, the reference data 125 may include only one of the first viscosity change amount ΔV1 and the second viscosity change amount ΔV2. In that case, the viscosity is estimated based on one kind of viscosity change amount included in the reference data 125 both during the viscosity increasing period and during the viscosity decreasing period. Thus, in an embodiment in which the viscosity is estimated based on the first viscosity change amount ΔV1, only the total flowing amount Q(a) at the time of execution of the current viscosity estimation processing may be required in each piece of viscosity estimation processing. In an embodiment in which the viscosity is estimated based on the second viscosity change amount ΔV2, only the total flowing amount Q(a−1) at the reference timing point, such as the timing point of most-recent execution of the viscosity estimation processing, may be required in each piece of viscosity estimation processing.

Figure 8:
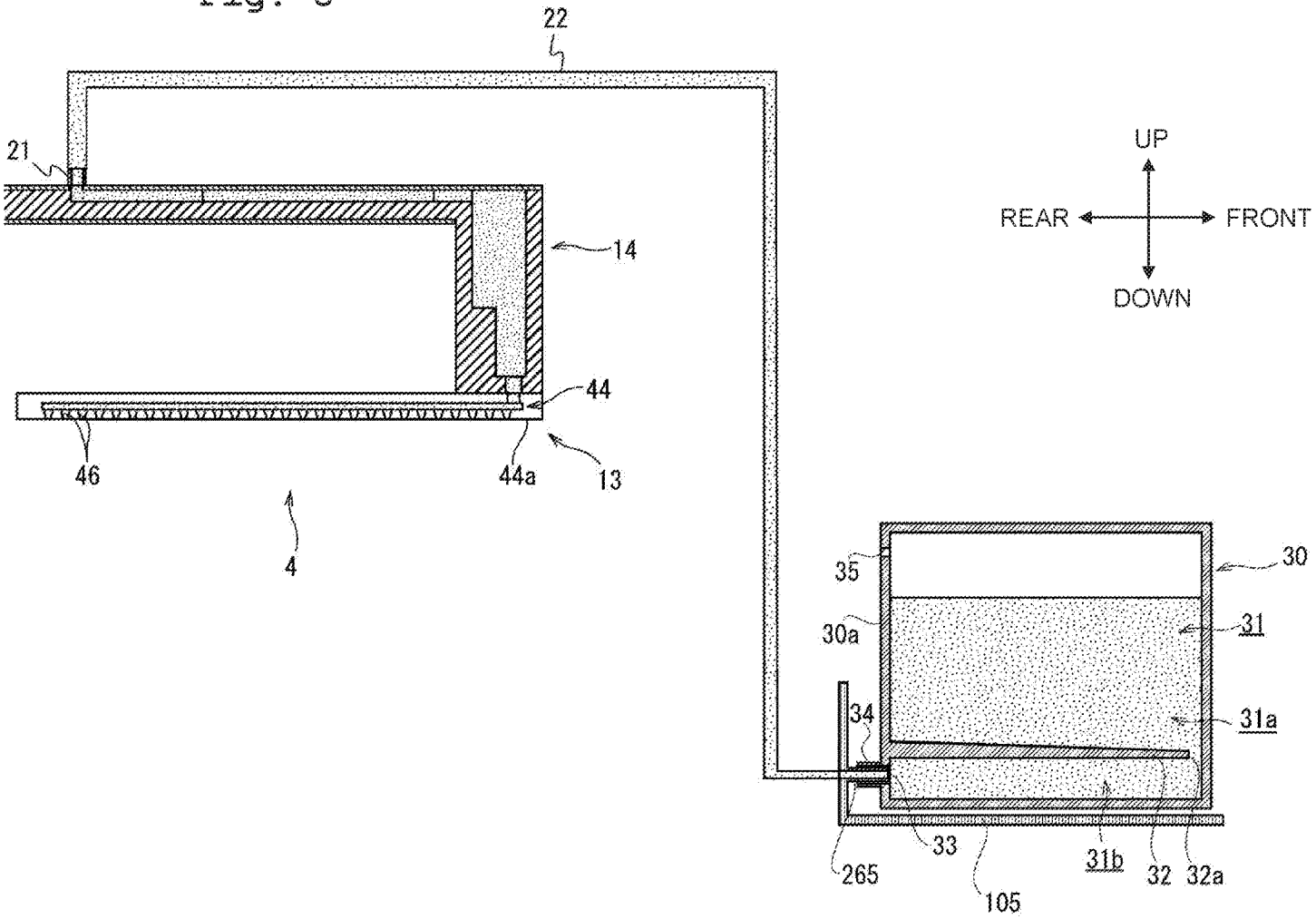
FIG. 8 is a vertical cross-sectional view schematically depicting an ink-jet head, a main tank, and a sub tank according to a modified embodiment.

As depicted in FIG. 8, no sub tank may be provided between the main tank 30 and the head 4. Namely, a needle 265 similar to the needle 65 may be provided in a tank installation section 205 in which the main tank 30 is installed, and the needle 265 may be connected to the head 4 via the supply tube 22. In that configuration, the viscosity of the ink flowing through the supply port 33 of the main tank 30 may be estimated in the viscosity estimation processing.

In the above embodiment, the viscosity estimation processing is executed for each predefined time (one month) that is the same as the above unit time. The present teaching, however, is not limited thereto. For example, the viscosity estimation processing may be executed every two months. In that case, an amount acquired by multiplying the viscosity change amount ΔVc estimated in the above embodiment by the predefined time that is an execution interval for the viscosity estimation processing is the viscosity change amount of the ink flowing through the outlet 66 after the reference timing point until the current timing point.

In the above embodiment, the ink discharge operation executed by the purge unit 9 is the suction purge in which suction force acts on each nozzle 46. The present teaching, however, is not limited thereto. For example, a pressure pump may be provided in an intermediate position of the supply tube 22 to perform a pressure purge in which the pressure pump is driven to supply the ink to the head 4, discharging the ink from each nozzle 46. The purge unit may execute both the suction purge and the pressure purge.

The tank installation section may house not only the main tank but the sub tank. Namely, the sub tank may be provided in the tank installation section.

The present teaching can be applied to a line-type ink-jet printer in which an image is printed on a sheet conveyed by a conveying mechanism in a state where an ink-jet head is fixed. The above description has been made about an example in which the present teaching is applied to the printer that performs printing on the sheet P by jetting the ink from nozzles. The present teaching, however, is not limited thereto. For example, the present teaching can be applied to a liquid jetting apparatus that performs printing by jetting a liquid other than the ink, such as a material of a wiring pattern printed on a printed circuit board.

What is claimed is:

1. A liquid jetting apparatus, comprising:

a head configured to jet liquid supplied from a liquid tank;

a memory configured to store pieces of reference data, each of the pieces of reference data being reference data related to estimated change in viscosity of the liquid in the liquid tank on an assumption that a supply amount of the liquid supplied from the liquid tank per unit time is a fixed amount, the pieces of reference data being different in the fixed amount; and a controller configured to estimate the viscosity of the liquid in the liquid tank every time a predefined time passes, wherein, in a case of estimating the viscosity of the liquid in the liquid tank, the controller is configured to:

acquire a total supply amount of the liquid supplied from the liquid tank after an initial timing point at which the liquid in the liquid tank is suppliable to the head and before a most-recent estimation timing point of the viscosity of the liquid in the liquid tank, or a cumulative supply amount being a total supply amount of the liquid supplied from the liquid tank after the initial timing point and before a current estimation timing point of the viscosity of the liquid in the liquid tank, and a supply amount of the liquid supplied from the liquid tank per unit time within the predefined time, estimate a viscosity change amount being a change amount of the viscosity of the liquid in the liquid tank within the predefined time based on the cumulative supply amount acquired, the supply amount per unit time acquired, and the pieces of reference data stored in the memory, and estimate the viscosity of the liquid in the liquid tank based on the viscosity change amount estimated and the viscosity of the liquid in the liquid tank at the initial timing point or the most-recent estimation timing point of the viscosity of the liquid in the liquid tank.

2. A liquid jetting apparatus, comprising:

a head configured to jet liquid supplied from a liquid tank;

a memory configured to store initial viscosity data and pieces of reference data, the initial viscosity data being related to initial viscosity which is viscosity of the liquid in the liquid tank at an initial timing point at which the liquid in the liquid tank is suppliable to the head, each of the pieces of reference data being reference data related to estimated change in the viscosity of the liquid in the liquid tank on an assumption that a supply amount of the liquid supplied from the liquid tank per unit time is a fixed amount, the pieces of reference data being different in the fixed amount; and a controller configured to estimate the viscosity of the liquid in the liquid tank every time a predefined time passes and to store, in the memory, the viscosity estimated as viscosity of the liquid in the liquid tank at a time of an estimation, wherein, in a case of estimating the viscosity of the liquid in the liquid tank, the controller is configured to:

acquire a cumulative supply amount including at least a total supply amount of the liquid supplied from the liquid tank after the initial timing point and before a most-recent estimation timing point of the viscosity of the liquid in the liquid tank, and a supply amount of the liquid supplied from the liquid tank per unit time within the predefined time, estimate a viscosity change amount being a change amount of the viscosity of the liquid in the liquid tank within the predefined time based on the cumulative supply amount acquired, the supply amount per unit time acquired, and the pieces of reference data stored in the memory, and estimate the viscosity of the liquid in the liquid tank based on the viscosity change amount estimated, and an initial viscosity or a latest viscosity of the liquid in the liquid tank being stored in the memory before a current estimation timing point of the viscosity of the liquid in the liquid tank.

3. The liquid jetting apparatus according to claim 1, wherein the liquid tank has a supply port configured to supply the liquid to the head, and the viscosity of the liquid in the liquid tank is a viscosity of the liquid flowing through the supply port.

4. The liquid jetting apparatus according to claim 1, wherein the liquid tank includes:

a first storage chamber configured to store the liquid; and a second storage chamber having an inlet which communicates with a lower portion of the first storage chamber to allow the liquid to flow into the second storage chamber and a supply port disposed below the inlet to supply the liquid to the head, and the viscosity of the liquid in the liquid tank is a viscosity of the liquid flowing through the supply port of the second storage chamber.

5. The liquid jetting apparatus according to claim 1, wherein each of the pieces of reference data is related to estimated change in the viscosity of the liquid in the liquid tank from the initial timing point.

6. The liquid jetting apparatus according to claim 1, wherein the pieces of reference data include first reference data and second reference data, the fixed amount of the second reference data being greater than the fixed amount of the first reference data, and the controller is configured to estimate the viscosity of the liquid in the liquid tank by performing interpolation for the viscosity change amount corresponding to the supply amount per unit time acquired, based on a first viscosity change amount estimated based on the cumulative supply amount acquired and the first reference data, a second viscosity change amount estimated based on the cumulative supply amount acquired and the second reference data, the fixed amount of the first reference data, and the fixed amount of the second reference data.

7. The liquid jetting apparatus according to claim 1, wherein the liquid stored in the liquid tank is a pigment ink.

8. The liquid jetting apparatus according to claim 1, wherein the liquid stored in the liquid tank is a pigment ink, the controller is configured to estimate a first change amount and a second change amount based on the cumulative supply amount acquired, the supply amount per unit time acquired, and the pieces of reference data stored in the memory, the first change amount being a change amount of the viscosity of the liquid in the liquid tank per unit time within the predefined time, the second change amount being a change amount of the viscosity of the liquid in the liquid tank per unit supply amount of the liquid supplied from the liquid tank at the most-recent estimation timing point of the viscosity of the liquid in the liquid tank, in the case of estimating the viscosity of the liquid in the liquid tank, the controller is configured to determine whether the first change amount is positive or negative, in a case that the controller has determined that the first change amount is positive, the controller is configured to estimate an amount acquired by multiplying the first change amount by the predefined time, as the viscosity change amount, and in a case that the controller has determined that the first change amount is negative, the controller is configured to estimate an amount acquired by multiplying the second change amount by the supply amount per unit time acquired and the predefined time, as the viscosity change amount.

9. The liquid jetting apparatus according to claim 8, wherein the memory stores lower-limit viscosity data indicating a lower-limit viscosity of the liquid in the liquid tank, in the case of determining that the first change amount is negative, the controller is configured to correct the viscosity change amount currently estimated such that viscosity of the liquid in the liquid tank to be estimated after the current estimation is gradually converged on the lower-limit viscosity indicated by the lower-limit viscosity data stored in the memory.

10. The liquid jetting apparatus according to claim 9, wherein the controller is configured to adjust a value of the lower-limit viscosity indicated by the lower-limit viscosity data stored in the memory, based on a highest viscosity among viscosities of the liquid in the liquid tank estimated after the initial timing point.

11. The liquid jetting apparatus according to claim 1, further comprising a liquid discharge unit configured to discharge the liquid from the head, wherein the controller is configured to control the liquid discharge unit to discharge the liquid in accordance with a discharge condition determined by the viscosity of the liquid in the liquid tank estimated.

12. The liquid jetting apparatus according to claim 2, wherein, in the case of estimating the viscosity of the liquid in the liquid tank, the controller is configured to acquire a total supply amount of the liquid supplied from the liquid tank after the initial timing point and before the current estimation timing point of the viscosity of the liquid in the liquid tank, as the cumulative supply amount.

13. The liquid jetting apparatus according to claim 2, wherein the liquid tank has a supply port configured to supply the liquid to the head, and the viscosity of the liquid in the liquid tank is a viscosity of the liquid flowing through the supply port.

14. The liquid jetting apparatus according to claim 2, wherein the liquid tank includes:

a first storage chamber configured to store the liquid; and a second storage chamber having an inlet which communicates with a lower portion of the first storage chamber to allow the liquid to flow into the second storage chamber and a supply port disposed below the inlet to supply the liquid to the head, and the viscosity of the liquid in the liquid tank is a viscosity of the liquid flowing through the supply port of the second storage chamber.

15. The liquid jetting apparatus according to claim 2, wherein each of the pieces of reference data is data related to estimated change in the viscosity of the liquid in the liquid tank from the initial timing point.

16. The liquid jetting apparatus according to claim 2, wherein the pieces of reference data include first reference data and second reference data, the fixed amount of the second reference data being greater than the fixed amount of the first reference data, and the controller is configured to estimate the viscosity of the liquid in the liquid tank by performing interpolation for the viscosity change amount corresponding to the supply amount per unit time acquired, based on a first viscosity change amount estimated based on the cumulative supply amount acquired and the first reference data, a second viscosity change amount estimated based on the cumulative supply amount acquired and the second reference data, the fixed amount of the first reference data, and the fixed amount of the second reference data.

17. The liquid jetting apparatus according to claim 2, wherein the liquid stored in the liquid tank is a pigment ink.

18. The liquid jetting apparatus according to claim 2, wherein the liquid stored in the liquid tank is a pigment ink, the controller is configured to estimate a first change amount and a second change amount based on the cumulative supply amount acquired, the supply amount per unit time acquired, and the pieces of reference data stored in the memory, the first change amount being a change amount of the viscosity of the liquid in the liquid tank per unit time within the predefined time, the second change amount being a change amount of the viscosity of the liquid in the liquid tank per unit supply amount of the liquid supplied from the liquid tank at the most-recent estimation timing point of the viscosity of the liquid in the liquid tank, in the case of estimating the viscosity of the liquid in the liquid tank, the controller is configured to determine whether the first change amount is positive or negative, in a case that the controller has determined that the first change amount is positive, the controller is configured to estimate an amount acquired by multiplying the first change amount by the predefined time, as the viscosity change amount, and in a case that the controller has determined that the first change amount is negative, the controller is configured to estimate an amount acquired by multiplying the second change amount by the supply amount per unit time acquired and the predefined time, as the viscosity change amount.

19. The liquid jetting apparatus according to claim 18, wherein the memory stores lower-limit viscosity data indicating a lower-limit viscosity of the liquid in the liquid tank, in the case of determining that the first change amount is negative, the controller is configured to correct the viscosity change amount currently estimated so that viscosity of the liquid in the liquid tank to be estimated after the current estimation is gradually converged on the lower-limit viscosity indicated by the lower-limit viscosity data stored in the memory.

20. The liquid jetting apparatus according to claim 2, further comprising a liquid discharge unit configured to discharge the liquid from the head, wherein the controller is configured to control the liquid discharge unit to discharge the liquid in accordance with a discharge condition determined by the viscosity of the liquid in the liquid tank estimated.

* * * * *